US009531071B2

(12) United States Patent
Guterman et al.

(10) Patent No.: US 9,531,071 B2
(45) Date of Patent: Dec. 27, 2016

(54) ANTENNA STRUCTURES HAVING RESONATING ELEMENTS AND PARASITIC ELEMENTS WITHIN SLOTS IN CONDUCTIVE ELEMENTS

(71) Applicant: Apple Inc., Cupertino, CA (US)

(72) Inventors: Jerzy S. Guterman, Mountain View, CA (US); Hao Xu, Cupertino, CA (US); Douglas Blake Kough, San Jose, CA (US); Eduardo Lopez Camacho, Watsonville, CA (US); Mattia Pascolini, San Francisco, CA (US); Robert W. Schlub, Cupertino, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/992,213

(22) Filed: Jan. 11, 2016

(65) Prior Publication Data

US 2016/0118718 A1 Apr. 28, 2016

Related U.S. Application Data

(63) Continuation of application No. 12/888,350, filed on Sep. 22, 2010, now Pat. No. 9,236,648.

(51) Int. Cl.
*H01Q 1/24* (2006.01)
*H01Q 5/357* (2015.01)
(Continued)

(52) U.S. Cl.
CPC ..... *H01Q 5/357* (2015.01); *H01Q 1/2266* (2013.01); *H01Q 5/378* (2015.01)

(58) Field of Classification Search
USPC ..... 343/700 MS, 702, 767
See application file for complete search history.

(56) References Cited

U.S. PATENT DOCUMENTS 4,509,056 A 4/1985 Ploussios
5,463,406 A 10/1995 Vannatta et al.
(Continued)

FOREIGN PATENT DOCUMENTS

EP 1083622 3/2001
JP 2000004120 7/2000
(Continued)

*Primary Examiner* — Hoang V Nguyen
*Assistant Examiner* — Hai Tran
(74) *Attorney, Agent, or Firm* — Treyz Law Group, P.C.; G. Victor Treyz; Michael H. Lyons

(57) ABSTRACT

Electronic devices may include radio-frequency transceiver circuitry and antenna structures. The antenna structures may include antenna resonating elements such as dual-band antenna resonating elements that resonate in first and second communications bands. The antenna structures may also contain parasitic antenna elements such as elements that are operative in only the first or second communications band and elements that are operative in both the first and second communications bands. The antenna resonating elements and parasitic elements may be mounted on a common dielectric carrier. The dielectric carrier may be mounted within a slot or other opening in a conductive element. The conductive element may be formed from conductive housing structures in an electronic device such as a portable computer. The portable computer may have a clutch barrel with a dielectric cover. The dielectric cover may overlap and cover the slot and the dielectric carrier.

19 Claims, 24 Drawing Sheets

(51) Int. Cl.
*H01Q 1/22* (2006.01)
*H01Q 5/378* (2015.01)

(56) References Cited

U.S. PATENT DOCUMENTS

| | | | | |
|---|---|---|---|---|
| 5,784,032 | A | 7/1998 | Johnston et al. | |
| 5,917,458 | A | 6/1999 | Ho et al. | |
| 6,184,845 | B1 | 2/2001 | Leisten et al. | |
| 6,414,643 | B2 | 7/2002 | Cheng et al. | |
| 6,456,249 | B1 | 9/2002 | Johnson | |
| 6,486,836 | B1 | 11/2002 | Hill | |
| 6,552,692 | B1 | 4/2003 | Zeilinger et al. | |
| 6,570,538 | B2 | 5/2003 | Vaisanen et al. | |
| 6,614,400 | B2 | 9/2003 | Egorov | |
| 6,639,558 | B2 | 10/2003 | Kellerman et al. | |
| 6,987,485 | B2 | 1/2006 | Ito et al. | |
| 7,053,850 | B1 | 5/2006 | Bogdans et al. | |
| 7,068,229 | B2 | 6/2006 | Lin | |
| 7,551,142 | B1 * | 6/2009 | Zhang | H01Q 1/243 343/700 MS |
| 7,595,759 | B2 | 9/2009 | Schlub et al. | |
| 7,639,190 | B2 | 12/2009 | Shimasaki et al. | |
| 7,768,461 | B2 | 8/2010 | Cheng et al. | |
| 7,768,462 | B2 | 8/2010 | Zhang et al. | |
| 7,804,458 | B2 | 9/2010 | Montgomery et al. | |
| 8,059,039 | B2 | 11/2011 | Ayala Vazquez et al. | |
| 8,269,675 | B2 | 9/2012 | Kough et al. | |
| 2005/0041624 | A1 | 2/2005 | Hui et al. | |
| 2006/0038736 | A1 | 2/2006 | Hui et al. | |
| 2006/0238437 | A1 | 10/2006 | Huang | |
| 2007/0069958 | A1 | 3/2007 | Ozkar | |
| 2008/0106478 | A1 | 5/2008 | Hill | |
| 2008/0143611 | A1 | 6/2008 | Wang | |
| 2008/0258992 | A1 | 10/2008 | Tsai | |
| 2009/0051604 | A1 | 2/2009 | Zhang et al. | |
| 2009/0174611 | A1 | 7/2009 | Schlub et al. | |
| 2009/0174612 | A1 | 7/2009 | Ayala et al. | |
| 2010/0073241 | A1 | 3/2010 | Vazquez et al. | |
| 2010/0073242 | A1 | 3/2010 | Vazquez et al. | |
| 2010/0073243 | A1 | 3/2010 | Vazquez et al. | |
| 2010/0156741 | A1 | 6/2010 | Vazquez et al. | |
| 2012/0169550 | A1 | 7/2012 | Schlub et al. | |
| 2013/0293425 | A1 | 11/2013 | Zhu et al. | |

FOREIGN PATENT DOCUMENTS

| | | |
|---|---|---|
| JP | 2004363848 | 12/2004 |
| JP | 2006527941 | 12/2006 |
| TW | 200843205 A | 11/2008 |
| WO | 2004112187 | 12/2004 |
| WO | 2006018711 | 2/2006 |
| WO | 2009142000 | 11/2009 |

* cited by examiner

ANTENNA STRUCTURES HAVING RESONATING ELEMENTS AND PARASITIC ELEMENTS WITHIN SLOTS IN CONDUCTIVE ELEMENTS

This application is a continuation of U.S. patent application Ser. No. 12/888,350, filed Sep. 22, 2010, which is hereby incorporated by reference herein in its entirety. This application claims the benefit of and claims priority to U.S. patent application Ser. No. 12/888,350, filed Sep. 22, 2010.

BACKGROUND

This relates to wireless electronic devices, and, more particularly, to antenna structures for wireless electronic devices.

Electronic devices such as computers and handheld electronic devices are often provided with wireless communications capabilities. For example, electronic devices may use cellular telephone circuitry to communicate using cellular telephone bands. Electronic devices may use short-range wireless communications links to handle communications with nearby equipment. For example, electronic devices may communicate using the WiFi® (IEEE 802.11) bands at 2.4 GHz and 5 GHz and the Bluetooth® band at 2.4 GHz.

To satisfy consumer demand for small form factor wireless devices, manufacturers are continually striving to implement wireless communications circuitry such as antenna components using compact structures. For example, antennas have been installed within the clutch barrel portion of portable computer housings. A portable computer clutch barrel contains hinges that allow the lid of the portable computer to open and close. In computers in which antennas have been mounted in the clutch barrel, the outer surface of the clutch barrel has been formed from plastic. The plastic is transparent at radio frequencies, so the antennas in the clutch barrel and transmit and receive radio-frequency antenna signals.

If care is not taken, however, antennas that are mounted in this way may exhibit performance variations as the lid of the computer is open and closed, may be subject to undesired losses, or may not exhibit satisfactory performance in configurations with small clutch barrels or multiple antennas.

It would therefore be desirable to be able to provide improved ways in which to provide electronic devices such as portable computers with antennas.

SUMMARY

Electronic devices such as portable computers may have components such as displays and processors that are mounted within housings. A housing for an electronic device such as a portable computer may, for example, include and upper housing that has a display and a lower housing that has a keyboard, track pad, and internal components such as components mounted on printed circuit boards.

The upper and lower housings in this type of device may be connected by hinge structures. The hinge structures may be mounted within a clutch barrel portion of the upper housing. The clutch barrel may have dielectric structures such as a dielectric clutch barrel cover. The upper and lower housings may contain metal housing walls and other conductive structures that form a conductive element that surrounds the clutch barrel. The dielectric structures of the clutch barrel may therefore form a dielectric opening in the form of a slot within the conductive housing structures.

Antenna structures may be mounted within the slot. The slot may have electromagnetic resonating characteristics that can be taken into account when mounting the antenna structures. For example, the slot may primarily affect antenna performance when the upper housing of the portable computer or other electronic device is open and not when the upper housing of the portable computer or other electronic device is closed. To avoid making the operation of the antenna structures dependent on the position of the upper housing relative to the lower housing, the antenna structures can be desensitized to the influence of the slot.

The antenna structures can include multiple isolated antenna resonating elements. The antenna resonating elements may each be dual-band antenna resonating elements that are fed by transmission lines at respective antenna feed terminals. The resonating elements may be formed from conductive traces on a common dielectric carrier. A ground trace may be formed on the carrier.

Parasitic antenna elements may be incorporated into the antenna structures to help desensitize the antenna structures to the presence of the slot while satisfying other antenna performance criteria. Parasitic antenna elements may have structures that are formed from conductive traces on the same dielectric carrier as the antenna resonating elements. The ground trace on the carrier can serve as a common ground for the antenna resonating elements and for the parasitic antenna elements.

The dielectric carrier may be mounted within the slot in conductive housing structures or other conductive element. The clutch barrel cover may overlap the slot and may cover the dielectric carrier.

Further features of the invention, its nature and various advantages will be more apparent from the accompanying drawings and the following detailed description of the preferred embodiments.

DETAILED DESCRIPTION

Figure 1:
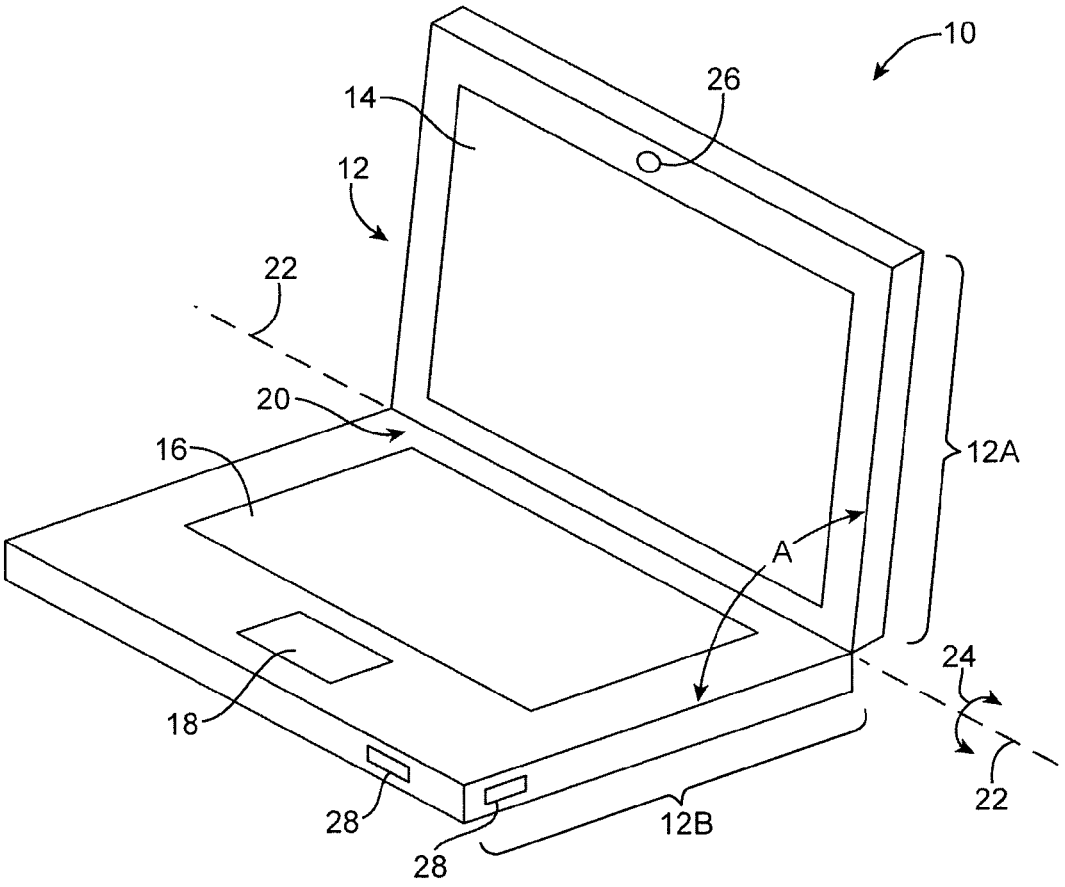
FIG. 1 is a perspective view of an illustrative electronic device in accordance with an embodiment of the present invention.

An electronic device such as electronic device 10 of FIG. 1 may contain wireless circuitry. For example, electronic device 10 may contain wireless communications circuitry that operates in long-range communications bands such as cellular telephone bands and wireless circuitry that operates in short-range communications bands such as the 2.4 GHz Bluetooth® band and the 2.4 GHz and 5 GHz WiFi® wireless local area network bands (sometimes referred to as IEEE 802.11 bands).

Device 10 may be a handheld electronic device such as a cellular telephone, media player, gaming device, or other device, may be a laptop computer, tablet computer, or other portable computer, may be a desktop computer, may be a television or set top box, or may be other electronic equipment. Configurations in which device 10 has a rotatable lid as in a portable computer are sometimes described herein as an example. This is, however, merely illustrative. Device 10 may be any suitable electronic equipment.

As shown in the example of FIG. 1, device 10 may have a housing such as housing 12. Housing 12 may be formed from plastic, metal (e.g., aluminum), fiber composites such as carbon fiber, glass, ceramic, other materials, and combinations of these materials. Housing 12 or parts of housing 12 may be formed using a unibody construction in which housing structures are formed from an integrated piece of material. Multipart housing constructions may also be used in which housing 12 or parts of housing 12 are formed from frame structures, housing walls, and other components that are attached to each other using fasteners, adhesive, and other attachment mechanisms.

Some of the structures in housing 12 may be conductive. For example, metal parts of housing 12 such as metal housing walls may be conductive. Other parts of housing 12 may be formed from dielectric material such as plastic, glass, ceramic, non-conducting composites, etc. To ensure that antenna structures in device 10 function properly, care should be taken when placing the antenna structures relative to the conductive portions of housing 12. If desired, portions of housing 12 may form part of the antenna structures for device 10. For example, conductive housing sidewalls may form an antenna ground element. Antennas may be mounted in openings in housing 12 such as slot-shaped openings. In doing so, the resonant behavior of the openings (i.e., the electromagnetic behavior of the openings at radio frequencies) is preferably taken into account to ensure satisfactory antenna operation.

As shown in FIG. 1, device 10 may have input-output devices such as track pad 18 and keyboard 16. Camera 26 may be used to gather image data. Device 10 may also have components such as microphones, speakers, buttons, removable storage drives, status indicator lights, buzzers, sensors, and other input-output devices. These devices may be used to gather input for device 10 and may be used to supply a user of device 10 with output. Ports in device 10 such as ports 28 may receive mating connectors (e.g., an audio plug, a connector associated with a data cable such as a Universal Serial Bus cable, a data cable that handles video and audio data such as a cable that connects device 10 to a computer display, television, or other monitor, etc.).

Device 10 may include a display such a display 14. Display 14 may be a liquid crystal display (LCD), a plasma display, an organic light-emitting diode (OLED) display, an electronic ink display, or a display implemented using other display technologies. A touch sensor may be incorporated into display 14 (i.e., display 14 may be a touch screen display). Touch sensors for display 14 may be resistive touch sensors, capacitive touch sensors, acoustic touch sensors, light-based touch sensors, force sensors, or touch sensors implemented using other touch technologies.

Device 10 may have a one-piece housing or a multi-piece housing. As shown in FIG. 1, for example, electronic device 10 may be a device such as a portable computer or other device that has a two-part housing formed from upper housing 12A and lower housing 12B. Upper housing 12A may include display 14 and may sometimes be referred to as a display housing or lid. Lower housing 12B may sometimes be referred to as a base or main housing. Housings 12A and 12B may be connected to each other using a hinge (e.g., a hinge located in region 20 along the upper edge of lower housing 12B and the lower edge of upper housing 12A). The hinge may allow upper housing 12A to rotate about axis 22 in directions 24 relative to lower housing 12B. The plane of lid (upper housing) 12A and the plane of lower housing 12B may be separated by an angle that varies between 0° when the lid is closed to 90° or more when the lid is fully opened.

Figure 2:
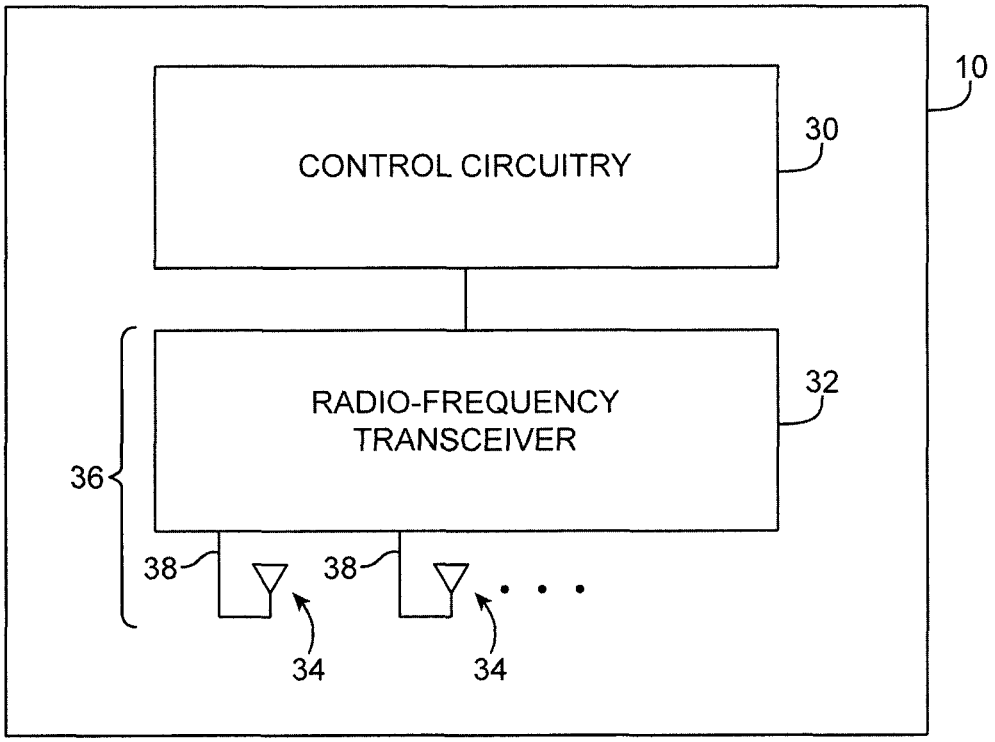
FIG. 2 is a schematic diagram of an illustrative electronic device with wireless circuitry that includes antenna structures and transceiver circuitry in accordance with an embodiment of the present invention.

As shown in FIG. 2, device 10 may include control circuitry 30. Control circuitry 30 may include storage such as flash memory, hard disk drive memory, solid state storage devices, other nonvolatile memory, random-access memory and other volatile memory, etc. Control circuitry 30 may also include processing circuitry. The processing circuitry of control circuitry 30 may include digital signal processors, microcontrollers, application specific integrated circuits, microprocessors, power management unit (PMU) circuits, and processing circuitry that is part of other types of integrated circuits.

Wireless circuitry 36 may be used to transmit and receive radio-frequency signals. Wireless circuitry 36 may include wireless radio-frequency transceiver 32 and one or more antennas 34 (sometimes referred to herein as antenna structures). Wireless transceiver 32 may transmit and receive radio-frequency signals from device 10 using antenna structures 34. Circuitry 36 may be used to handle one or more communications bands. Examples of communications bands that may be handled by circuitry 36 include cellular telephone bands, satellite navigation bands (e.g., the Global Positioning System band at 1575 MHz), bands for short range links such as the Bluetooth® band at 2.4 GHz and wireless local area network (WLAN) bands such as the IEEE 802.11 band at 2.4 GHz and the IEEE 802.11 band at 5 GHz, etc.

When more than one antenna is used in device 10, radio-frequency transceiver circuitry 32 can use the antennas to implement multiple-input and multiple-output (MIMO) protocols (e.g., protocols associated with IEEE 802.11(n) networks) and antenna diversity schemes. Multiplexing arrangements can be used to allow different types of traffic to be transmitted and received over a common antenna structure. For example, transceiver 32 may transmit and receive both 2.4 GHz Bluetooth® signals and 802.11 signals over a shared antenna.

Transmission line paths such as path 38 may be used to couple antenna structures 34 to transceiver 32.

Transmission lines in path 38 may include coaxial cable paths, microstrip transmission lines, stripline transmission lines, edge-coupled microstrip transmission lines, edge-coupled stripline transmission lines, transmission lines formed from combinations of transmission lines of these types, etc.

During operation, antennas 34 may receive incoming radio-frequency signals that are routed to radio-frequency transceiver circuitry 32 by paths 38. During signal transmission operations, radio-frequency transceiver circuitry 32 may transmit radio-frequency signals that are conveyed by paths 38 to antenna structures 34 and transmitted to remote receivers.

Figure 3:
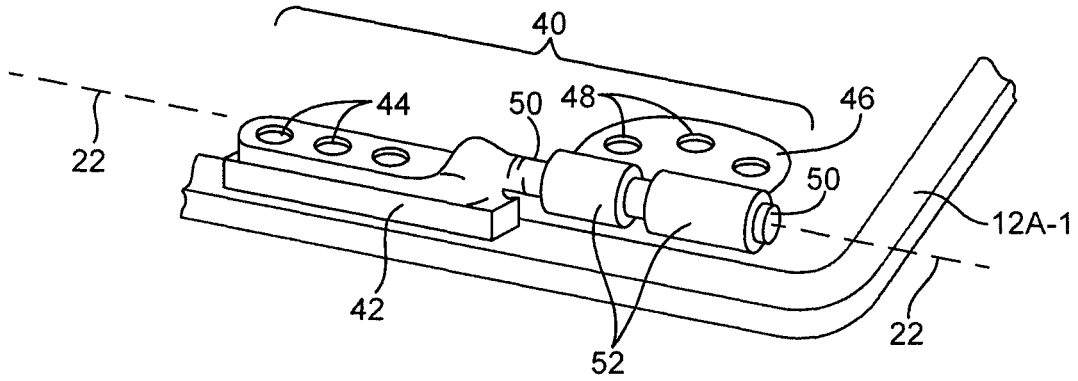
FIG. 3 is a perspective view of an illustrative hinge that may be used in an electronic device with housing portions that rotate relative to each other in accordance with an embodiment of the present invention.

Hinges may be used to allow portions of an electronic device to rotate relative to each other. Hinges may, for example, be used to allow upper housing 12A of FIG. 1 to rotate relative to lower housing 12B about rotational axis 22. The hinge structures that are used to attach housings 12A and 12B together are sometimes referred to as clutch structures or clutches. An illustrative clutch (hinge) is shown in FIG. 3. As shown in FIG. 3, clutch (hinge) 40 may have a structure such as structure 42 and a structure such as structure 46 that rotate relative to each other about axis 22. Structure 42 may have holes such as holes 44 that receive screws. The screws may be used to attach structure 42 to frame structure 12A-1 or other structures in upper housing 12A. Structure 46 may be attached to housing 12B using screws that pass through holes 48. If desired, other attachment techniques may be used to mount structure 42 to housing 12A and to mount structure 46 to housing 12B. The use of screws is merely illustrative.

Structure 42, which may sometimes referred to as a clutch pillar, may include shaft 50. Structure 46, which may sometimes be referred to as a clutch band, may have portions 52 that grip shaft 50 with a predetermined amount of friction. During operation, the clutch band holds the clutch pillar with an amount of force that allows upper housing 12A to rotate relative to lower housing 12B. Sufficient friction is present to allow a user to place upper housing 12A at a desired angle relative to lower housing 12B without slipping. Structure 12A-1 may be attached to other structures in housing 12A such as display 14, housing wall structures (e.g., metal housing structures), etc. The portions of housing 12B that are attached to structure 46 may include housing structures such as a metal frame, metal sidewalls, and other housing structures.

Figure 4:
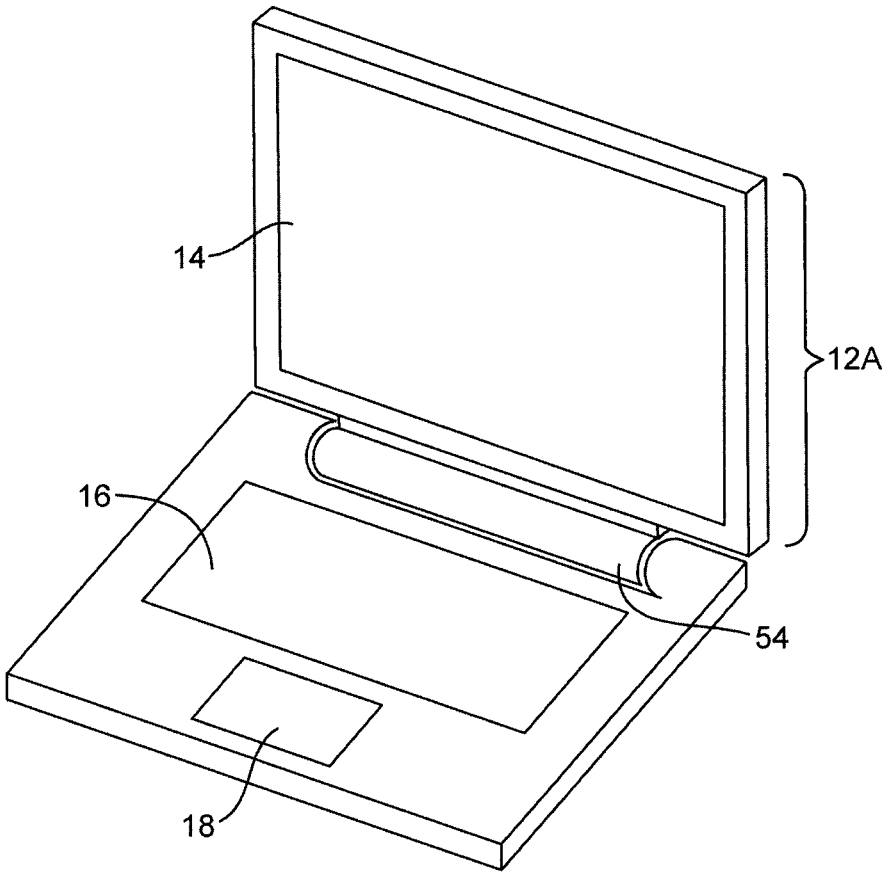
FIG. 4 is a perspective view of an illustrative electronic device such as a portable computer showing how the electronic device may have a clutch barrel in which antennas and hinge structures can be mounted in accordance with an embodiment of the present invention.

A pair of hinge structures such as hinge 40 of FIG. 3 may be mounted within portions of housing 12. As shown in FIG. 4, for example, hinge structures such as hinge 40 may be mounted in a portion of housing 12A such as clutch barrel 54. Clutch barrel 54 may have a cylindrical shape as shown in FIG. 4 or may have other shapes. If desired, clutch barrel 54 may be formed as a portion of housing 12B.

Clutch barrel 54 may have a cover that is formed from a dielectric such as plastic. This allows the clutch barrel to serve as a mounting location for antenna structures. During operation, the clutch barrel cover allows radio-frequency signals to be transmitted and received by the antenna structures within the clutch barrel. Antenna structures may also be mounted at other locations within device 10 such as along the upper edge of display 12 (e.g., under the upper bezel of housing 12A), in lower housing 12B, under dielectric window structures in housing 12A or housing 12B, behind layers of glass or other dielectrics, or elsewhere in housing 12. An advantage of mounting antenna structures within the clutch barrel is that this location does not require the use of potentially unsightly antenna windows on prominent portions of housing 12 and may permit antenna operation both when lid 12A is open and when lid 12A is closed.

Clutch barrel 54 may be formed primarily of dielectric materials (e.g., a dielectric carrier such as a plastic carrier for supporting patterned conductive antenna structures, a plastic cover or a cover formed from other dielectrics, etc.). Air (which is a dielectric) may also be present within clutch barrel 54. Surrounding portions of device 10 may be substantially conductive. For example, structures in upper housing 12A such as frame 12A-1 of FIG. 3, display 14 of FIG. 1, and metal housing sidewalls in which display 14 and frame 12A-1 are mounted may all be conductive. Likewise, structures in housing 12B such as metal housing sidewalls, metal frame structures, ground planes on printed circuit boards, radio-frequency shielding structures, and other device components in housing 12B may be conductive.

Figure 5:
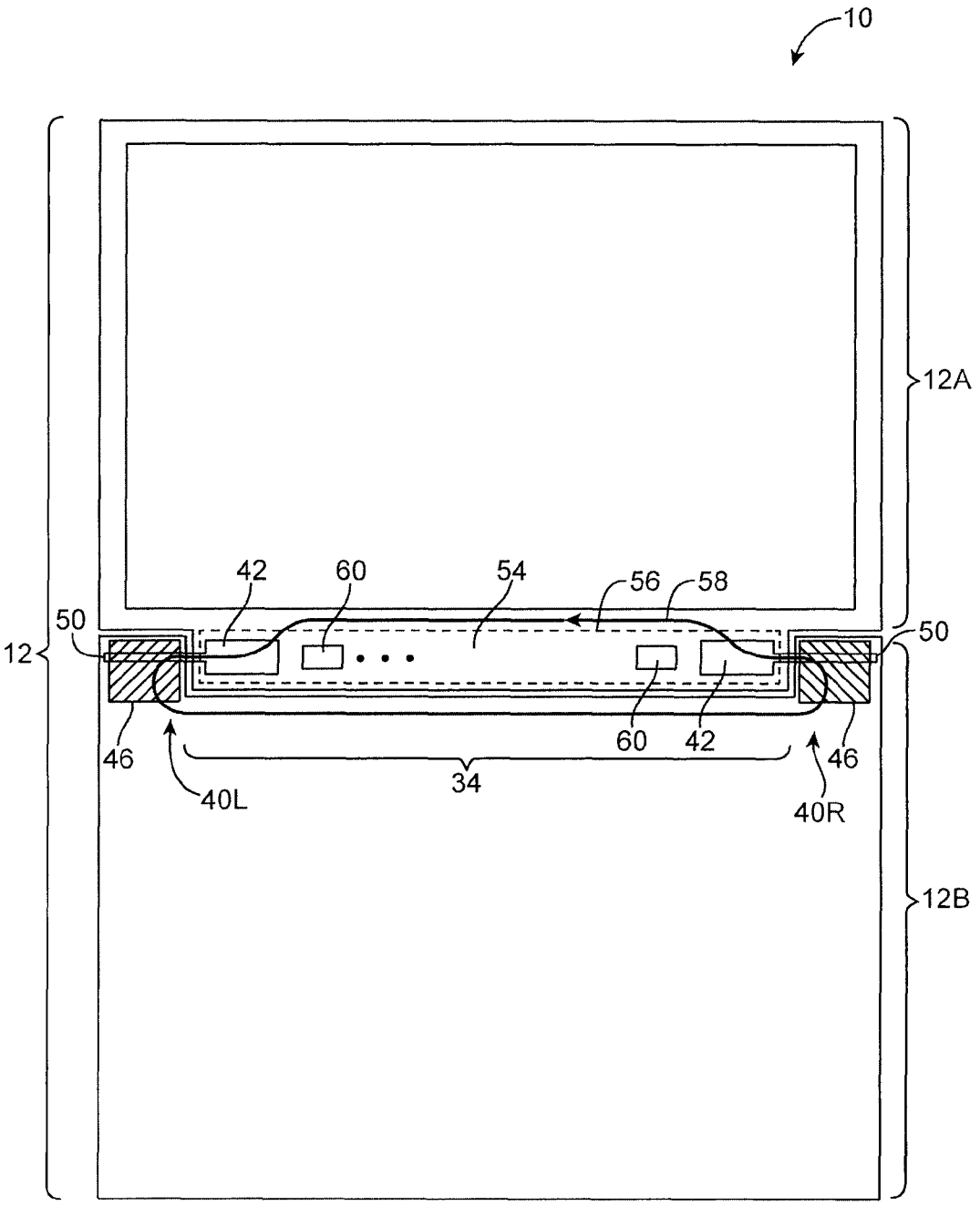
FIG. 5 is a diagram showing how housing structures in an electronic device such as a portable computer with hinges may form a slot in accordance with an embodiment of the present invention.

As a result of this construction, clutch barrel 54 may be formed substantially of dielectric and the portions of housing 12 that surround clutch barrel 54 may be formed of conductor. As illustrated in FIG. 5, this gives rise to a slot-shaped dielectric opening (shown by dashed line 56) within the surrounding conductive structures of housing 12. Opening 56 may sometimes be referred to as a slot. The surrounding conductive portions of housing 12 are sometimes collectively referred to as a forming a conductive element (ground). Because the conductive element completely surrounds the slot, slots such as slot 56 are sometimes referred to as closed slots.

One or more antenna components such as components 60 may be mounted within slot 56. Components 60 may include active antenna components such as directly fed antenna resonating elements (sometimes referred to herein as "antenna resonating elements" or "resonating elements"). Components 60 may also include passive (unfed) antenna components such as parasitic antenna resonating elements (sometimes referred to herein as parasitic elements). Components 60 may be used to form antenna structures 34 (see, e.g., FIG. 2). Respective transmission line paths 38 (FIG. 2) may be coupled between transceiver 32 and each of the resonating elements in antenna structures 34.

Slot 56 (i.e., the shape of the conductive element surrounding dielectric-filled slot 56) has electromagnetic characteristics that influence the behavior of antenna structures 34. Antenna slot 56 may serve as a type of parasitic antenna resonator that operates in conjunction with components 60. In some situations, the electromagnetic characteristics of slot 56 make it easier for a particular resonating element to transmit and receive signals (i.e., antenna efficiency is increased for that resonating element when compared to a scenario in which the resonating element operates in free space). In other situations (i.e., when a resonating element is positioned differently within the slot or is operated at a different frequency), the electromagnetic characteristics of slot 56 make it harder for that resonating element to transmit and receive signals (i.e., antenna efficiency is decreased relative to a free space configuration).

The presence of slot 56 may therefore have a significant impact on antenna performance and should be taken into consideration when determining the optimal location of components 60. For example, locations for components 60 should be chosen that allow antenna structures 34 to perform efficiently without exhibiting excessive coupling between resonating elements. When resonating elements exhibit satisfactory electromagnetic isolation (e.g., 10 dB or more), protocols such as MIMO protocols may be effectively used by transceiver 32.

It may also be desirable to choose locations for components 60 that do not make antenna structures 34 overly sensitive to the position of lid 12A. The shape of housing 12 may give rise to slot 56 primarily when lid 12A is open and not when lid 12A is closed (as an example). In this type of environment (i.e., when the impact of slot 56 varies as a function of lid position due to changes in device geometry), it may be desirable to locate components 60 in positions in which antenna performance is substantially the same regardless of lid position. These positions typically correlate with locations within slot 56 that do not overlap excessively with slot resonances.

The slot resonances (sometimes referred to as modes) that are associated with slot 56 are influenced by the shape of slot 56. The shape of slot 56 is determined by the shape of the conductive structures (conductive element) surrounding the slot. The upper edge of slot 56 is generally bounded by the lower edge of display housing 12A (i.e., the lowermost conductive portions of housing 12A such as frame structures, display structures, and metal housing walls). The lower edge of slot 56 is generally formed by the upper edge of housing 12B (e.g., metal housing walls, other conductive structures, etc.). Hinges 40L and 40R and the fastening structures that attach hinges 40L and 40R to housings 12A and 12B may be formed from conductive materials such as metal. As shown by looped arrow 58 in FIG. 5, which roughly traces the periphery of slot 56, the conductive nature of the hinges allows current to flow through hinges 40R and 40L (as well as the other portions of the conductive element surrounding slot 56). The shape of slot 56 is therefore affected by the shape of left hinge 40L at the left edge of slot and the shape of right hinge 40R at the right edge of the slot.

Figure 6:
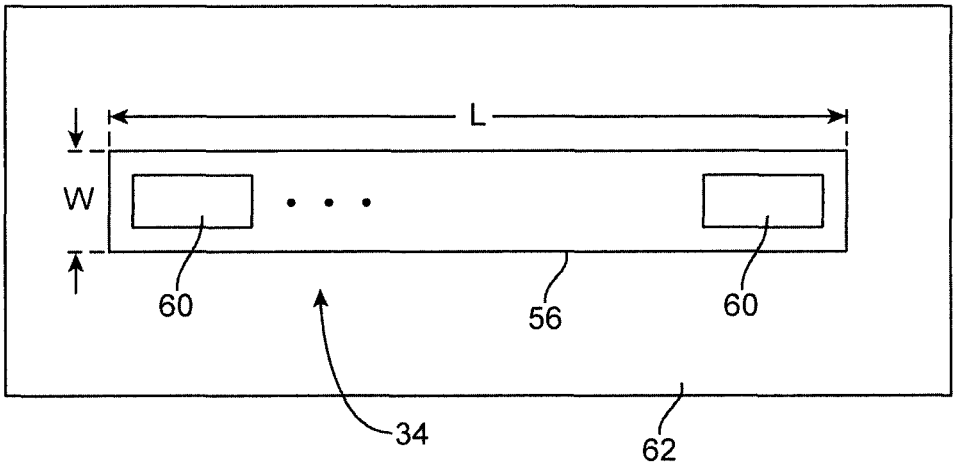
FIG. 6 is a diagram showing how antenna structures such as antenna resonating elements and parasitic elements may be mounted within a slot in accordance with an embodiment of the present invention.

The precise shape of the slot (i.e., the degree to which the edges of the slot are straight and parallel) typically has less influence on the electromagnetic behavior of the slot than the slot perimeter. A diagram showing how slot 56 may be modeled as having a rectangular shape of length L and width W is shown in FIG. 6. As shown in FIG. 6, slot 56 may be formed from an opening within conductive element 62 (i.e., the conductive structures of device 10 such as the metal housing walls of housing 12 and other structures that surround the air, plastic, and other dielectric within slot 56). Width W is typically significantly less than length L. For example, width W may be less than 3 cm, less than 2 cm, or less than 1 cm (as examples). Length L may be, for example, 5-35 cm, 10-20 cm, 20-30 cm, about 20 cm, less than 20 cm, more than 20 cm, 7-28 cm, 15-20 cm, etc. The length of the perimeter P of slot 56 (i.e., 2L+2W) is typically associated with a resonance peak (i.e., slot 56 will typically exhibit a resonance for electromagnetic signals having a wavelength equal to P). Harmonic frequencies (e.g., integral multiples of the fundamental resonant frequency) may also exhibit resonances.

Typical slots formed from housing structures such as clutch barrel 54 (FIG. 4) are somewhat narrow (i.e., W<<L for a typical clutch barrel). In slots such as these, slot perimeter P can be approximated as two times the length L of the slot (i.e., the slot length can be viewed as being of primary importance in determining the electromagnetic characteristics of the slot). Accordingly, the behavior of slot 56 is sometimes discussed herein in the context of the length of slot 56. In practice, additional factors, such as the shape of the slot perimeter, the dielectric constants of the dielectrics within and adjacent to the slot and the conductivities and shapes of the conductive components of device 10 within and adjacent to the slot will also affect antenna response.

Figure 7:
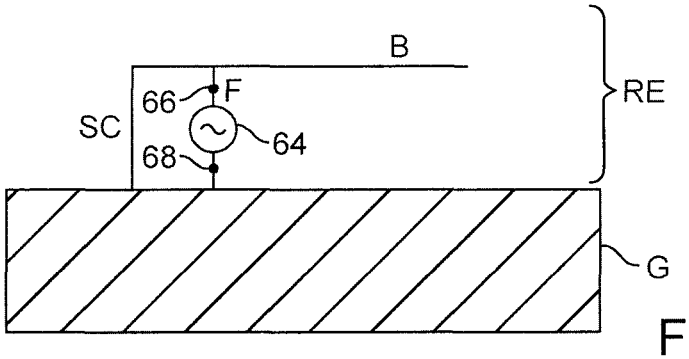
FIG. 7 is a diagram showing how an antenna for an electronic device may have an inverted-F antenna resonating element in accordance with an embodiment of the present invention.

Antenna components 60 of FIG. 6 may include resonating elements such as inverted-F elements, variants of inverted-F antennas, or other suitable antenna resonating elements. FIG. 7 shows an example of an inverted-F antenna resonating element RE and associated ground G. Resonating element RE of FIG. 7 may have a main resonating element branch B, a short circuit branch SC, and a feed branch F. Source 64 (i.e., a transmission line such as one of transmission lines 38 of FIG. 2 that is coupled to transceiver 32) may be connected to an antenna feed that includes positive antenna feed terminal 66 and ground antenna feed terminal 68.

Figure 8:
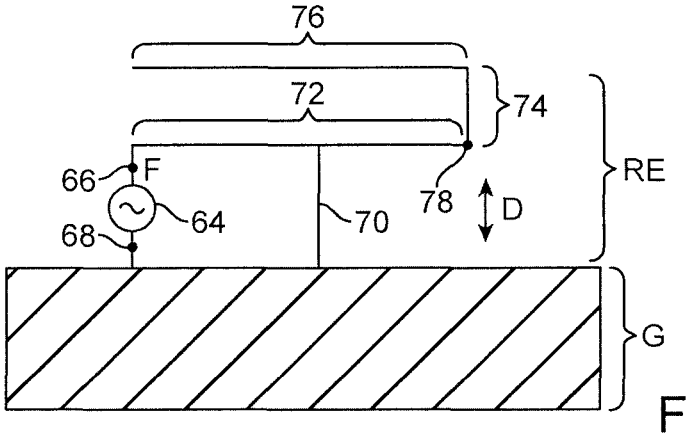
FIGS. 8 and 9 are diagrams of illustrative antenna structures having dual-band antenna resonating elements in accordance with an embodiment of the present invention.

Another example of a resonating element that may be used as one of components 60 within slot 56 of antenna structures 34 is shown in FIG. 8. In the example of FIG. 8, resonating element RE has been configured to operate at two different frequency bands (e.g., a lower band such as the 2.4 GHz band for use with Bluetooth® and WiFi® communications and an higher band such as at the 5 GHz band for use with WiFi® communications). At the higher frequency band (e.g., 5 GHz), there is an impedance discontinuity at node 78. This is because segment 74 is perpendicular to ground plane element G, which locates segment 74 and segment 76 at a greater distance D from ground G than segment 72. The increased distance D between segments 74 and 76 and ground G (compared to the distance of segment 72 and ground G) leads to reduced capacitance for segments 74 and 76 compared to segment 72 and therefore higher impedance at 5 GHz for segments 74 and 76 than for segment 72. The impedance discontinuity at node 78 effectively limits the active portion of element RE at 5 GHz to segment 72. The length of segment 72 may be chosen to resonate at 5 GHz, so that resonating element RE exhibits a 5 GHz resonant peak. Segment 70 may act as an impedance matching stub. At 2.4 GHz, the impedances of segments 72 and 76 are comparable, because of the impact of the difference in segment capacitances is reduced at lower frequencies. The total length of segments 72, 74, and 76 may be chosen to resonate at 2.4 GHz, while segment 70 again serves as a matching stub. Resonating element RE of FIG. 8 can therefore exhibit resonant peaks at both 5 GHz and 2.4 GHz (i.e., resonating element RE of FIG. 8 serves as a dual-band resonating element that covers both a low band at 2.4 GHz and a high band at 5 GHz). Other communications bands may be covered using this type of structure if desired. The use of 2.4 GHz and 5 GHz as illustrative communications bands in the FIG. 8 example is merely illustrative.

Figure 9:
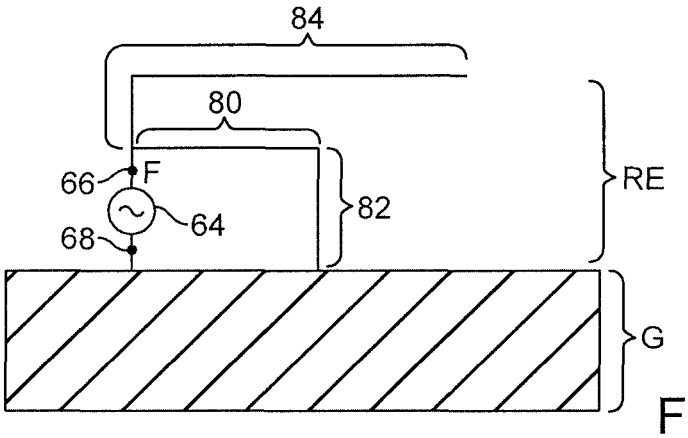

Antenna resonating element RE of FIG. 9 may also exhibit dual band operation (e.g., at a low band of 2.4 GHz and a high band of 5 GHz or other communications bands of interest). In the high band, segment 82, which serves as a shunt inductor, tends to be open circuited (i.e., segment 82 exhibits a relatively high impedance). The length of segment 80 may be selected so that segment 80 resonates at in the high band. This provides antenna resonating element RE with a high band resonance. In the low band, segments 80 and 82 serve as an impedance matching stub. The length of segment 84 may be chosen so that segment 84 resonates in the low band. This provides antenna resonating element RE of FIG. 9 with a low band resonance. Resonating element RE of FIG. 9 therefore has both low band and high band resonant peaks and can serve as a dual band antenna.

Figure 10:
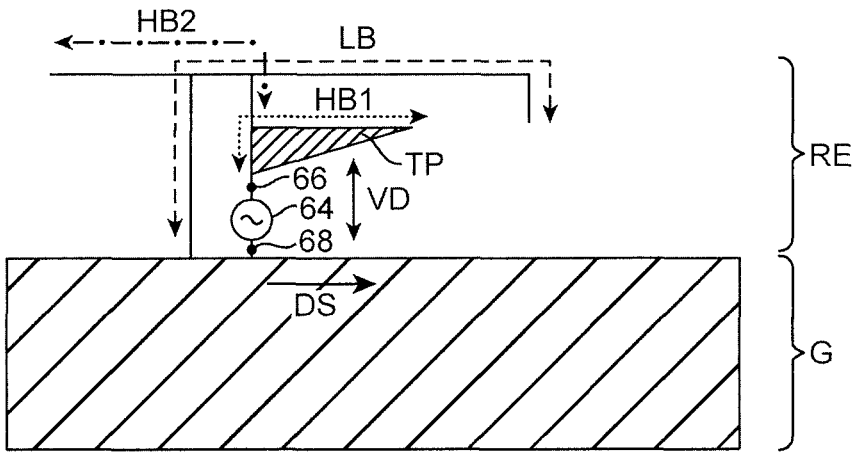
FIG. 10 is a diagram showing how an antenna for an electronic device may have a multiband inverted-F antenna resonating element with a conductive structure such as a triangular shaped conductor that serves as an impedance matching structure in accordance with an embodiment of the present invention.

FIG. 10 shows an illustrative multiband antenna arrangement that may be used in a low band of 2.4 GHz and a high band of 5 GHz (as an example). The length of conductor associated with dashed line LB may contribute to a resonant frequency of 2.4 GHz. The length of conductor associated with dotted line HB1 may be associated with a first high band resonance (e.g., in the vicinity of 5 GHz) and the length of conductor associated with dashed-and-dotted line HB2 may be associated with a second high band resonance (e.g., near to the resonance of HB1 in the vicinity of 5 GHz). The HB1 and HB2 resonances may operate together to provide the antenna structure of FIG. 10 with coverage at 5 GHz. Tapered conductive structure TP may have a lower edge that does not run parallel to ground G. This cause the separation VD between the lower edge of structure TP and ground G to vary as a function of lateral distance DS along ground plane G and the resonating element branch associated with segment HB1. In the example of FIG. 10, structure TP has a triangular shape and distance VD varies linearly as a function of distance DS. If desired, structure TP may have a curved lower edge or other shape. The tapered nature of structure TP may help smooth the transition between the antenna feed and the branches of the resonating element and may therefore improve impedance matching.

Figure 11:
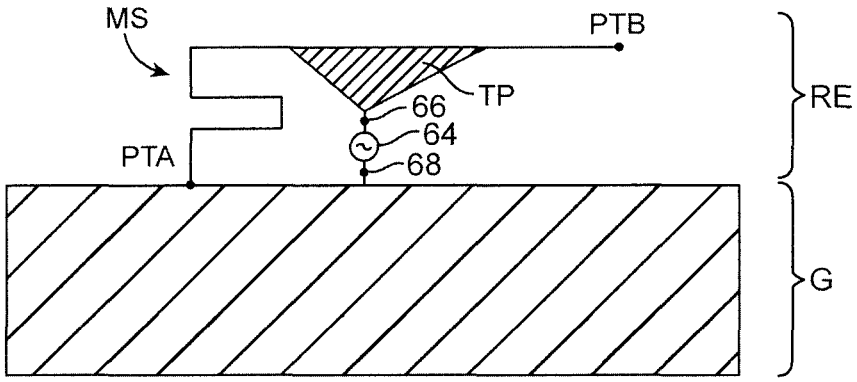
FIG. 11 is a diagram showing how an antenna for an electronic device may have a multiband inverted-F antenna resonating element with impedance matching structures in accordance with an embodiment of the present invention.

FIG. 11 shows an illustrative multiband antenna that may be used to operate at 2.4 GHz and 5 GHz (as an example). The antenna structures of FIG. 11 may include a resonating element conductor with a tapered structure TP and a meandering segment MS. The length of the resonating element conductor between points PTA and PTB may be associated with a half-wavelength resonance at 2.4 GHz and a full wavelength resonance at 5 GHz. The meandering shape of segment MS may conserve space. The tapered nature of section TP may provide a smooth transition for the antenna feed that improves impedance matching (e.g., at 5 GHz).

In addition to resonating elements (RE), components 60 within slot 56 may include parasitic elements (PAR). Parasitic elements may be configured so that they are effective at particular frequencies. For example, parasitic elements PAR may have L-shapes, T-shapes, spiral shapes, loop shapes, or other shapes with conductive segments of lengths that give rise to resonances at desired frequencies.

Figure 12:
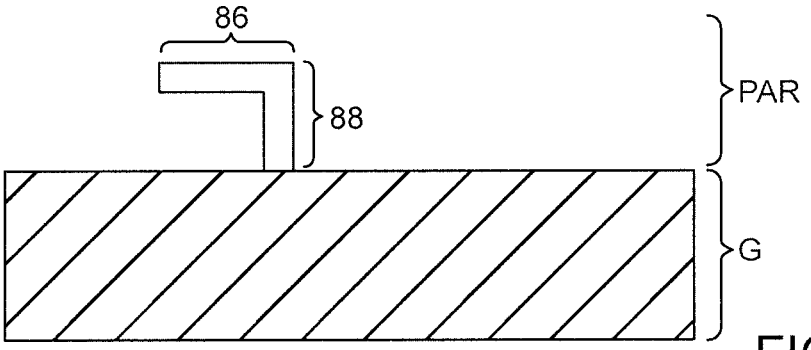
FIG. 12 is a diagram of an illustrative parasitic antenna element that may be used in antenna structures in accordance with an embodiment of the present invention.

An example of a resonating element that is tuned to operate at frequencies associated with a high communications band (5 GHz) is shown in FIG. 12. As shown in FIG. 12, parasitic element PAR may have segments 86 and 88. Segment 88, which may serve as a short circuit path, may run perpendicular to ground G (i.e., the longitudinal axis of segment 88 may lie perpendicular to the uppermost surface of ground G). Segment 86 may form a resonating branch that runs parallel to ground G. The length of segment 86 may be chosen so that segment 86 interacts with electromagnetic signals at a high band frequency of 5 GHz (as an example). When this type of parasitic element is included in slot 56, electromagnetic signals at 5 GHz will interact with the resonating branch of element PAR and will be shorted to ground via segment 88. Parasitic element PAR therefore forms a low impedance path to ground for radio-frequency signals at about 5 GHz. Signals at other frequencies (i.e., at 2.4 GHz) will exhibit significantly reduced interactions (i.e., parasitic element PAR of FIG. 12 will act as an open circuit at 2.4 GHz).

Figure 13:
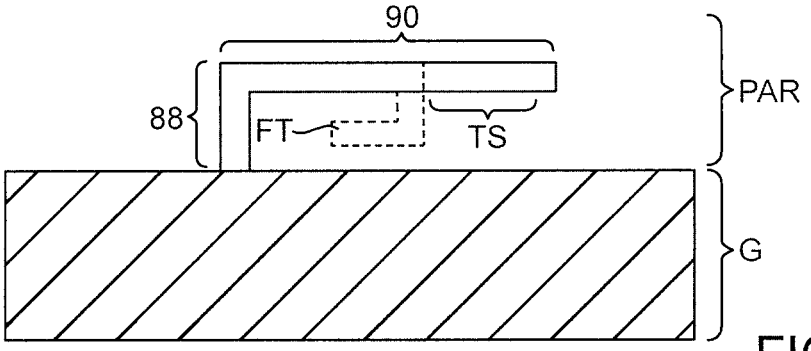
FIG. 13 is a diagram of an illustrative parasitic antenna element that is configured to operate at lower frequencies than the parasitic element of FIG. 12 in accordance with an embodiment of the present invention.

As shown in FIG. 13, parasitic element PAR may have a longer resonating branch such as the branch formed by segment 90. Segment 90 is longer than segment 86 of FIG. 12, so parasitic element PAR is effective at lower frequencies (e.g., low band frequencies of about 2.4 GHz). With this type of arrangement, parasitic element PAR of FIG. 13 forms an open circuit at high band frequencies (e.g., 5 GHz) and a short circuit to ground G at low band frequencies (e.g., 2.4 GHz). If desired, part of segment 90 such as tip section TP may be bent to form section FT. When segment 90 has a bent (meandering) tip of the type illustrated by section FT, parasitic element PAR may have a spiral shape that conserves space. A spiral shape of this type may be used for parasitic element PAR of FIG. 12 or other parasitic element structure.

Figure 14:
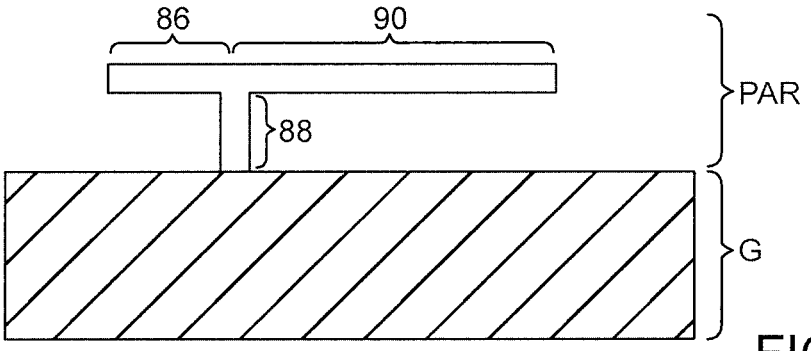
FIG. 14 is a diagram of an illustrative parasitic antenna element that is configured to operate at both the frequencies covered by parasitic elements of the type shown in FIG. 12 and the frequencies covered by parasitic elements of the type shown in FIG. 13 in accordance with an embodiment of the present invention.
Figure 15:
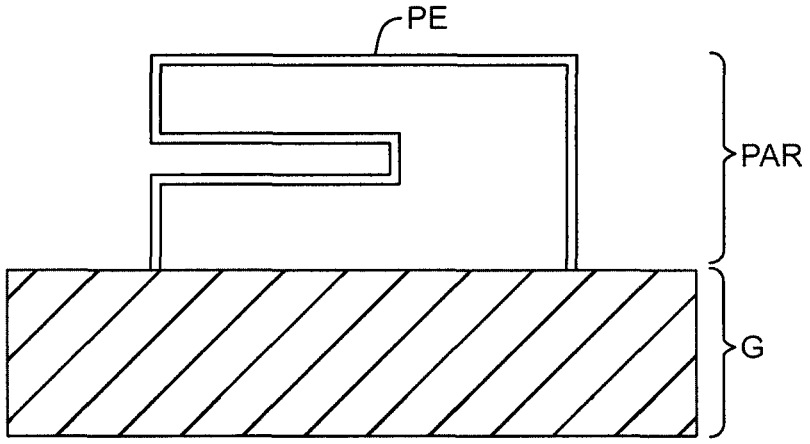
FIG. 15 is a diagram of an illustrative dual band parasitic antenna element implemented using a meandering loop configuration in accordance with an embodiment of the present invention.

If desired, parasitic elements in slot 56 may be configured to operate in multiple bands. As shown in FIG. 14, for example, parasitic element PAR may have both a short branch such as segment 86 and a long branch such as segment 90. Parasitic resonating element PAR of FIG. 14 therefore has a T-shape with branches of two different lengths. The short branch may be configured to respond at high band frequencies (e.g., at 5 GHz) and the long branch may be configured to respond at low band frequencies (e.g., at 2.4 GHz). With this type of arrangement, parasitic element PAR will form a low impedance path to ground G in both the low and high bands (i.e., at 2.4 GHz and at 5 GHz) and will exhibit higher impedances (open circuits) at other frequencies. If desired, the branches in the T-shaped element of FIG. 14 may be bent to form spirals, as described in connection with bent tip portion FT of segment 90 in FIG. 13. Parasitic elements may also be implemented using loop parasitic structures. An illustrative dual band parasitic element PAR that is formed from a meandering loop shape is shown in FIG. 15. Parasitic element PAR of FIG. 15 may operate at 2.4 GHz and 5 GHz (as an example).

Resonating elements RE and parasitic elements PAR may be formed from lengths of wire, patterned pieces of metal, strips of foil, or other conductive structures. With one suitable arrangement, resonating elements RE and parasitic elements PAR (and at least some of ground G) may be formed from conductive traces on substrates. Substrates that may be used include polymer substrates (e.g., plastics), printed circuit boards (e.g., rigid printed circuit boards such as printed circuit boards formed from fiber-glass filled epoxy, flexible printed circuit boards formed from one or more thin sheets of polyimide or other polymers, rigid flex, etc.), glass substrates, ceramic substrates, etc.

Figure 16:
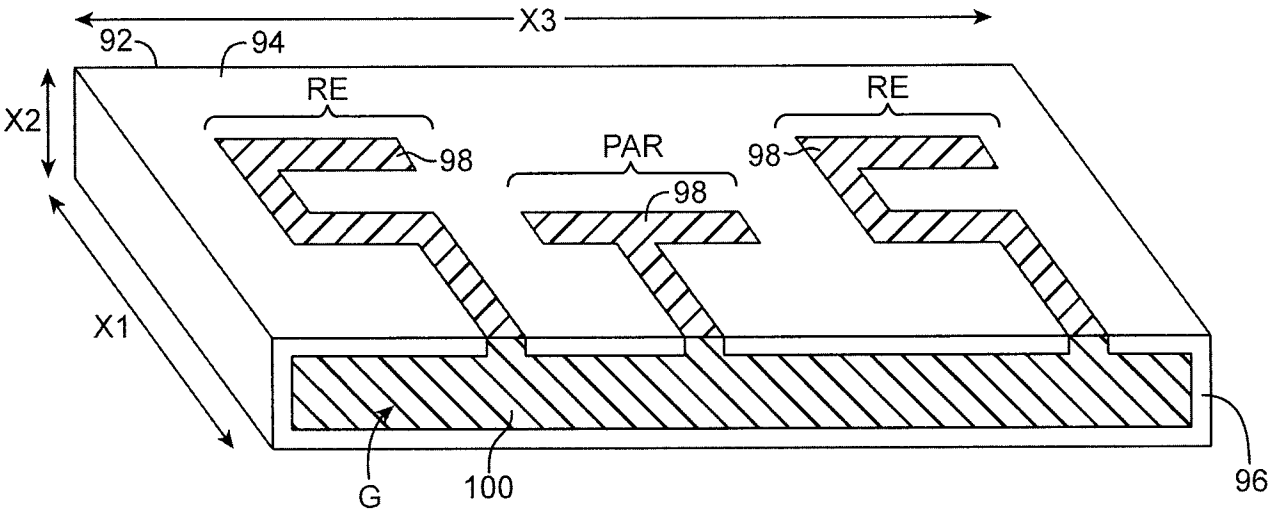
FIG. 16 is perspective view of an illustrative antenna carrier having traces that form two antenna resonating elements and a parasitic antenna element in accordance with an embodiment of the present invention.

An illustrative set of two resonating elements RE and a single interposed parasitic element PAR that have been formed on a plastic substrate is shown in FIG. 16. Plastic substrate 92 of FIG. 16, which may sometimes be referred to as a carrier, may be formed from a rigid or flexible polymer. As an example, carrier 92 may be formed from a piece of molded plastic having a width X1 of about 3-20 mm, a thickness X2 of about 0.5 to 3 mm, and a length X3 of about 7 to 30 cm or other suitable length that fits within clutch barrel 54 and slot 56. As shown in FIG. 16, resonating elements RE and parasitic element PAR may be formed from patterned metal traces 98 on surface 94 of carrier 92. Ground G, which may serve as a common ground for both antenna resonating elements and parasitic antenna elements, may be formed from patterned metal traces 100 on surface 96 of carrier 92.

Traces 98 and 100 may be formed by electroplating or other metallization techniques. To sensitize carrier 92 so that traces 98 and 100 are deposited in a desired pattern, carrier 92 may be formed using a two-shot molding process. With this type of process, a first shot of plastic may be formed from a material that does not attract metal during metallization and a second shot of plastic may be formed from a material that attracts metal during metallization. The first shot of plastic may be used to form the portions of carrier 92 in which no deposited metal is desired. The second shot of plastic may be used to form the portions of carrier 92 in which metal deposition is desired (i.e., the pattern of traces 98 and 100). Another sensitization technique that may be used involves using laser light to modify (e.g., roughen) the surface properties of carrier 92, so that traces 98 and 100 will form where laser light has patterned the carrier surface and so that no metal will deposit where laser light was not applied. Other patterning techniques may be used if desired (e.g., based on photolithography, stamped metal foil, patterned wires or metal parts, etc.).

Figure 17:
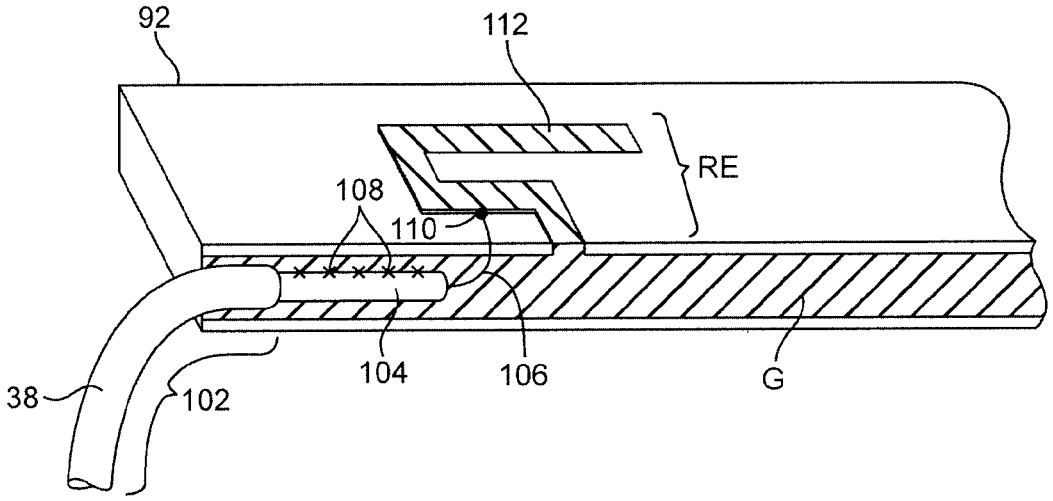
FIG. 17 is a perspective view of a portion of an antenna carrier of the type shown in FIG. 16 showing how a transmission line such as a coaxial cable may be attached to the carrier and used to feed an antenna resonating element on the carrier in accordance with an embodiment of the present invention.

FIG. 17 shows how a transmission line such as coaxial cable 38 may be used in feeding a resonating element. As shown in FIG. 17, coaxial cable 38 may have a first portion such as portion 102 that is insulated using a plastic jacket. Conductive outer braid conductor 104 may be exposed along a portion of ground conductor G and may be electrically connected to ground G using solder connections 108. Solder connections 108 form a first antenna feed terminal (e.g., antenna ground feed 68 of FIGS. 7-11). Trace 112 on carrier 92 may form antenna resonating element RE. Center positive conductor 106 of cable 38 may be soldered to point 110 on trace 112 to form a positive antenna feed terminal (e.g., positive antenna feed 66 of FIGS. 7-11). If desired, additional cables 38 may be routed along ground G in this way to feed additional resonating elements RE. Only one resonating element RE and one feeding transmission line 38 are shown in FIG. 17 to avoid over-complicating the drawings.

Satisfactory antenna performance for structures 34 can be obtained by optimizing the placement of resonating elements RE and parasitic elements PAR within slot 56. The distributions of electric fields that are supported by slot 56

(i.e., the modes supported by slot 56) can increase or decrease antenna efficiency for resonating elements operating at particular locations within slot 56. Antenna performance is also generally a function of operating frequency and is affected by the inclusion of additional resonating elements and parasitic elements within a slot. Satisfactory arrangements include a sufficient number of resonating elements RE to implement desired protocols (e.g., MIMO protocols or other protocols that involve multiple antennas) while exhibiting sufficient isolation between respective resonating elements RE. In some applications, it may only be necessary to use one or two resonating elements RE, but other designs may require three or more resonating elements RE to satisfy the demands of a MIMO protocol or other design criteria. Isolation levels between respective resonating elements may need to be about 10 dB or more (as an example). Because the size and shape of slot 56 and therefore its potential for affecting antenna performance can increase and decrease depending on the angle of lid 12A with respect to base 12B, it may be also be desirable to desensitize antenna structures 34 to the influence of lid location. Sufficient antenna efficiency and desired bands of operation should also be achieved.

Satisfying design constraints such as these simultaneously can be challenging. For example, changes to antenna resonating placement to achieve a desired amount of isolation between resonating elements may increase the sensitivity of the antenna structures to lid placement or may cause the efficiencies of the antennas to become too low or to become unbalanced. Incorporation of one or more parasitic elements PAR that are operative at appropriate frequencies may provide additional degrees of freedom in designing structures 34.

Figure 18:
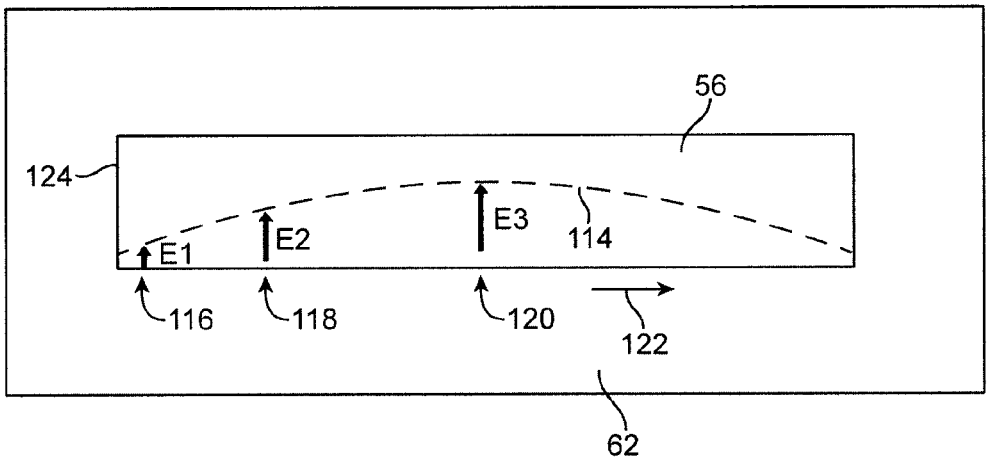
FIG. 18 is a diagram of an illustrative resonance mode for an antenna slot in accordance with an embodiment of the present invention.

A typical electric field distribution that is supported by slot 56 is shown in FIG. 18. As shown by dashed line 114 in FIG. 18, slot 56 may exhibit a mode with small electric field magnitudes near the ends of slot 56 (see, e.g., electric field E1 at position 116 near end 124 of slot 56) and strong electric field magnitudes near the middle of slot 56 (see, e.g., electric field E3 at position 120 near the midpoint along the length of slot 56). If an antenna resonating element RE were to be placed at location 120 in slot 56, the resulting antenna might be overly sensitive to the opening and closing of lid 12A, because the influence of slot 56 might, in certain types of device 10, be present only when lid 12A is open, not when lid 12A is closed. Locations such as location 116 are insensitive to the presence or absence of slot 56 and therefore offer satisfactory desensitization to lid position. However, locations along slot length dimension 122 such as location 116 generally provide insufficient separation between the conductive material of conductive element 62 (e.g., conductive portions of housing 12) and the resonating element, leading to unsatisfactory antenna efficiency and/or bandwidth. It may therefore generally be desirable to located an antenna resonating element RE within slot 56 at a position characterized by intermediate electric field strength E2 (i.e., position 118 in the example of FIG. 18).

In some antenna configurations, it may be possible to locate a resonating element at a location in slot 56 that performs well at multiple communications bands of interest. In other situations, it may not initially be possible identify a single location for a resonating element that simultaneously satisfies design criteria at both low and high bands (e.g., at both 2.4 GHz and at 5 GHz). The mode patterns supported by slot 56 are frequency dependent, so even if an antenna resonating element position can be identified that works well at one communications band, this location may not work well for another communications band of interest. In situations such as these and in other situations in which it is difficult to satisfy all design criteria simultaneously, one or more parasitic elements PAR such as parasitic elements PAR of FIGS. 12-15 may be incorporated into slot 56.

Incorporation of one or more parasitic resonating elements PAR within slot 56 provides additional degrees of freedom in designing antenna structures. For example, incorporation of a parasitic element PAR may change the effective length of slot 56 at one or more frequency bands and/or may effectively divide slot 56 into one or more shorter slots. This may make it possible to satisfy design constraints in a way that might otherwise not be possible.

Figure 19:
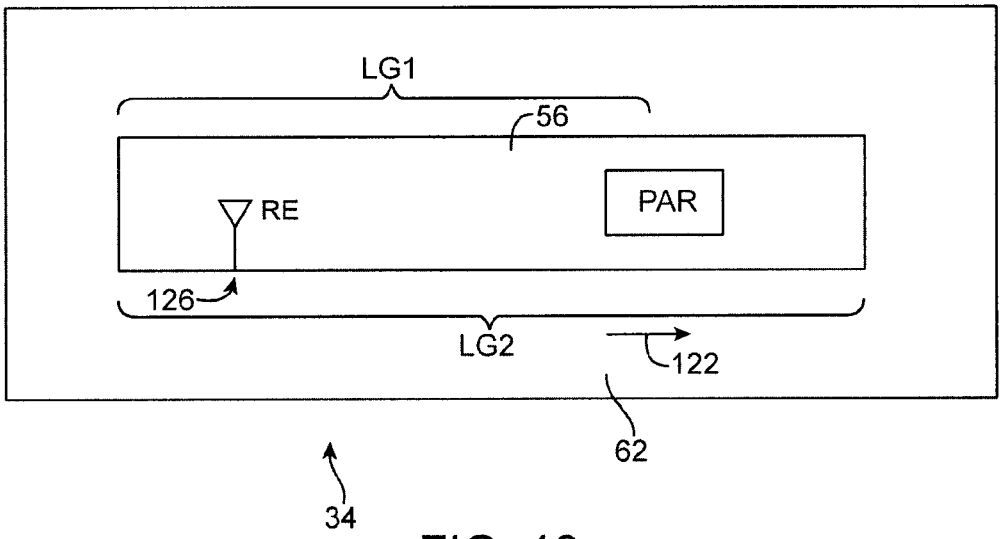
FIG. 19 is a diagram showing how an antenna resonating element and a parasitic element may be formed within a slot in accordance with an embodiment of the present invention.

Consider, as an example, antenna structures 34 of FIG. 19. In the FIG. 19 example, antenna resonating element 126 has been placed within slot 56 at position 126 along longitudinal slot dimension 122. The length of slot 56 may be determined primarily by external factors (e.g., the desired form factor for device 10). The physical length of slot 56 may therefore not be adjustable. Placement of resonating element RE at position 126 may be satisfactory for avoiding excessive slot resonances when antennas structures 34 are operated in a high communications band (e.g., at 5 GHz), but may undesirably coincide with a slot resonance when antenna structures 34 are operating in a low communications band (e.g., at 2.4 GHz). By incorporation of parasitic element PAR, the length (and perimeter) of slot 56 may be effectively shortened (e.g., from length LG2 to length LG1 in the FIG. 19 example).

Figure 20:
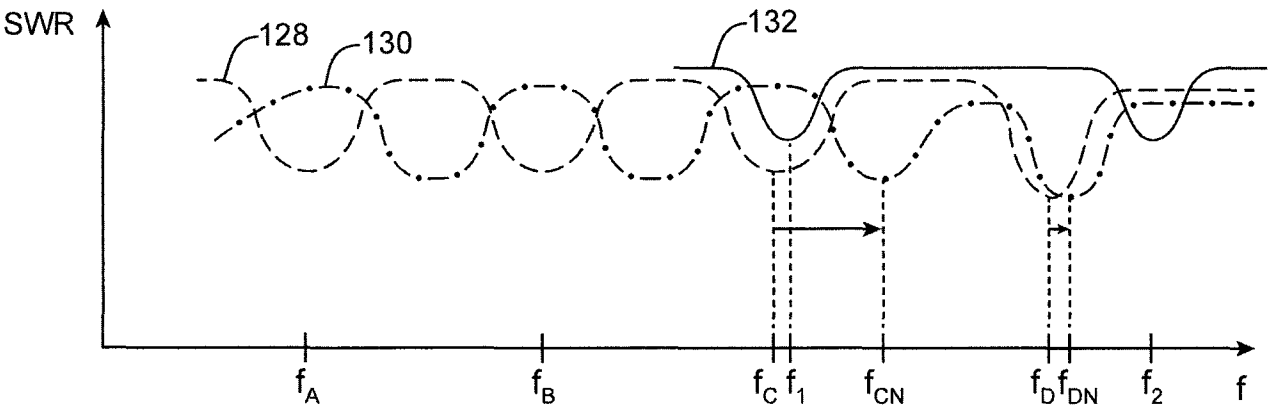
FIG. 20 is a graph showing how slot modes may interact with the performance of a dual-band antenna resonating element that is mounted within a slot and showing how a parasitic element may be used to adjust antenna performance in accordance with an embodiment of the present invention.
Figure 21:
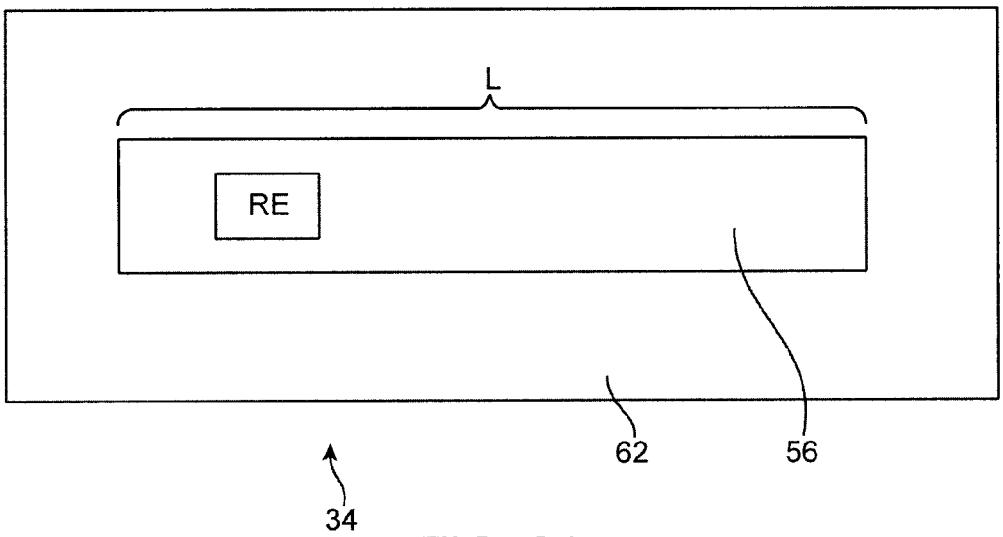
FIG. 21 is a diagram showing an illustrative location at which an antenna resonating element may be mounted in a slot within conductive structures in accordance with an embodiment of the present invention.

The impact of including parasitic element PAR into slot 56 of FIG. 19 in this type of scenario is illustrated by the graph of FIG. 20. In FIG. 20, the resonating characteristics of resonating element RE are represented by solid line 132. It is desired, in this example, to ensure that antenna structures 34 perform well in two communications bands of interest (i.e., both at the communications band centered at low band frequency f1 and at the communications band centered at high band frequency f2). Using a dual band resonating element design (e.g., a design of the type described in connection with FIG. 8 or FIG. 9), resonating element RE of FIG. 19 may exhibit satisfactory standing wave ratio (SWR) peaks at f1 and f2, as shown by solid line 132 in FIG. 20.

The resonating characteristics of slot 56 without parasitic element PAR are represented by dashed line 128. Slot 56 exhibits resonant peaks at fa, fb, fc, and fd. Frequency fd is sufficiently far away from high band f2 that the performance of antenna structures 34 will not be significantly affected by slot 56 in the high band. However, the slot resonance at frequency fc coincides with low band frequency f1. If corrective actions are not taken, this may cause antenna structures 34 to be overly sensitive to the influence of slot 56.

To ensure that both the low and high bands are sufficiently desensitized to the presence of slot 56, parasitic element PAR of FIG. 19 may be included in slot 56. Parasitic element PAR may use a design of the type shown in FIG. 13, so that the parasitic element is only effective at low band frequencies (i.e., at frequencies near f1, not frequencies in the vicinity of frequency f2). Parasitic element PAR therefore leaves the effective length of slot 56 unchanged at LG2 for high band frequencies, but shortens the effective length of slot 56 to LG1 at low band frequencies.

This effect is illustrated by dashed-and-dotted line 130 of FIG. 20, which represents the performance of slot 56 when parasitic element PAR is included. As shown in FIG. 20, the high frequency resonance of slot 56 at frequency fd shifts very slightly to frequency fdn due to the presence of parasitic element PAR. The shift between frequency fd and fdn is relatively small (in this example) because parasitic element PAR is tuned to operate in the low band and not in the high band. Because the resonant peak at frequency fdn is still sufficiently far away from high band frequency f2, antenna structures 32 that include parasitic element PAR will operate satisfactorily when parasitic element PAR is present and will not be overly sensitive to the presence of slot 56. At frequencies in the vicinity of low band frequency f1, parasitic element PAR is active and serves as a "short circuit" to ground G (see, e.g., FIG. 13). This shortens the effective length of slot 56 to length LG1 (FIG. 19) in the low band. As a result, the slot resonance at frequency fc is shifted to frequency fcn. The slot resonance at frequency fc overlapped with low band frequency f1 and therefore caused antenna structures 34 in the absence of parasitic element PAR to be overly sensitive to the presence of slot 56. When parasitic element PAR is present in slot 56, however, the shifted slot resonance at fcn no longer overlaps with low band frequency f1. The inclusion of parasitic element PAR in slot 56 therefore desensitizes antenna structures 34 of FIG. 19 to the influence of slot 56, so that antenna structures 34 satisfy design criteria at both the low band and high band frequencies.

Figure 22:
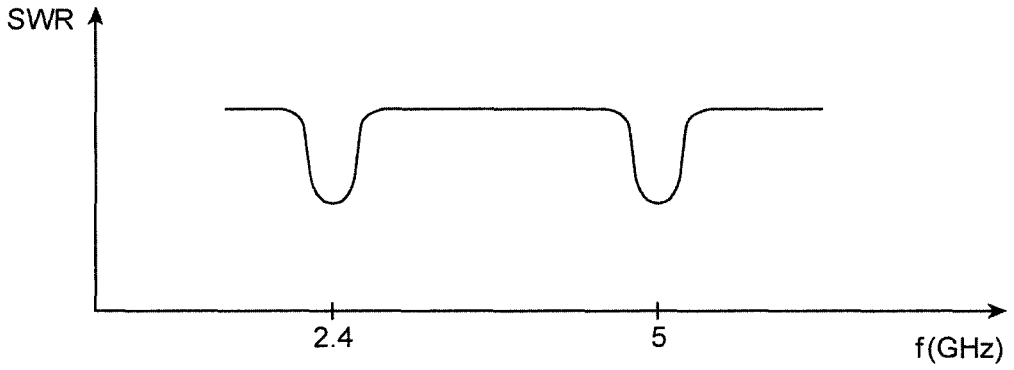
FIG. 22 is a graph showing how the antenna resonating element and slot of FIG. 21 may perform in accordance with an embodiment of the present invention.

Parasitic elements PAR can also be used to optimize performance in scenarios in which more than one resonating element RE is to be included in slot 56. When a single resonating element is included in a slot of physical length L, antenna structures 34 may, as an example, exhibit satisfactory low band (e.g. 2.4 GHz) and high band (e.g., 5 GHz) resonances, as shown in FIG. 22.

Figure 23:
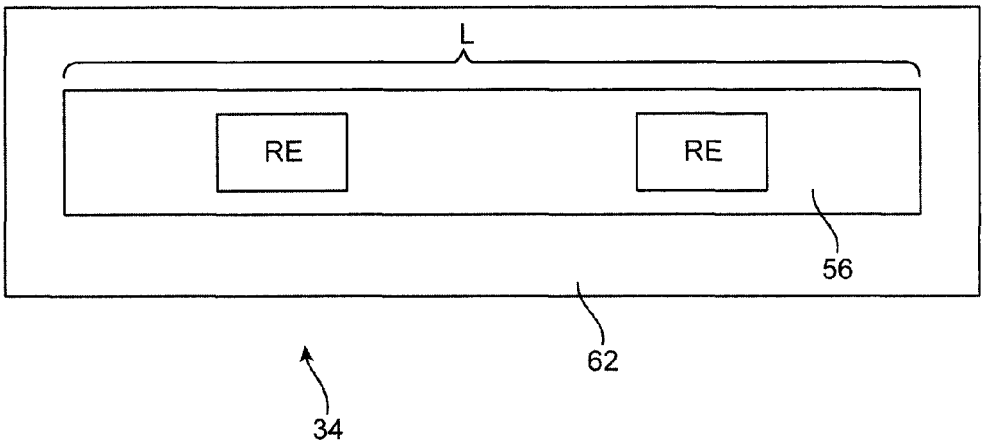
FIG. 23 is a diagram showing how a second resonating element may be mounted within the slot of FIG. 21 in accordance with an embodiment of the present invention.
Figure 24:
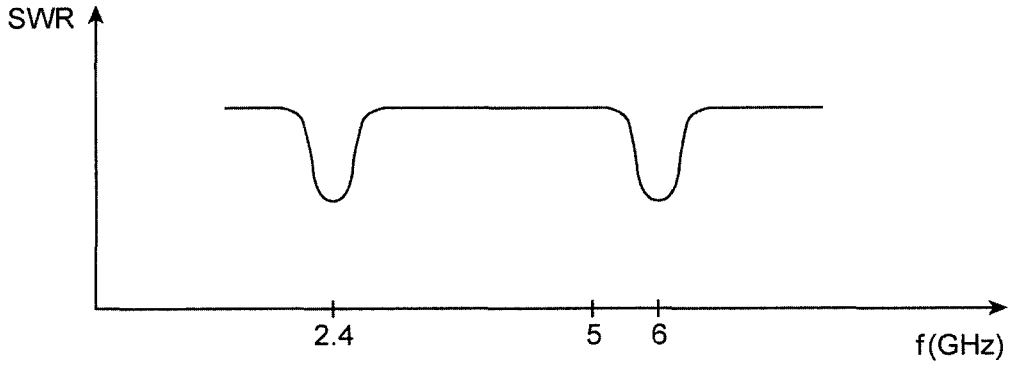
FIG. 24 is a graph showing how the performance of the antenna structures of FIG. 21 may be altered by the introduction of the second antenna resonating element of FIG. 23 in accordance with an embodiment of the present invention.

However, when a second resonating element RE is included in slot 56, as shown in FIG. 23, the presence of the second resonating element may perturb the modes of the slot. This may disturb the performance of the first antenna resonating element so that it high band resonant peaks shifts as shown in FIG. 24 (as an example). The FIG. 24 antenna response curve may not be satisfactory, because the high band resonance has shifted from 5 GHz to 6 GHz.

Figure 25:
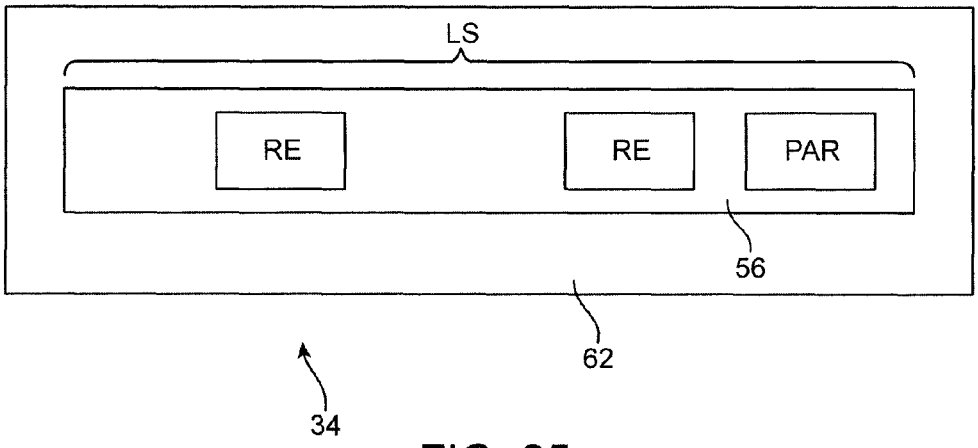
FIG. 25 is a diagram showing how a parasitic antenna element may be introduced into one end of the slot of FIG. 23 to alter the characteristics of the slot and thereby adjust antenna performance in accordance with an embodiment of the present invention.

The impact of the second element may be eliminated or reduced by introduction of parasitic element PAR of FIG. 25. When parasitic element PAR is present, the effective length of the slot may be reduced (e.g., to length LS), the modes of slot 56 may be correspondingly redistributed, and the performance of antenna structures 34 of FIG. 25 may be restored to the desired response of FIG. 22 (as an example).

Figure 26:
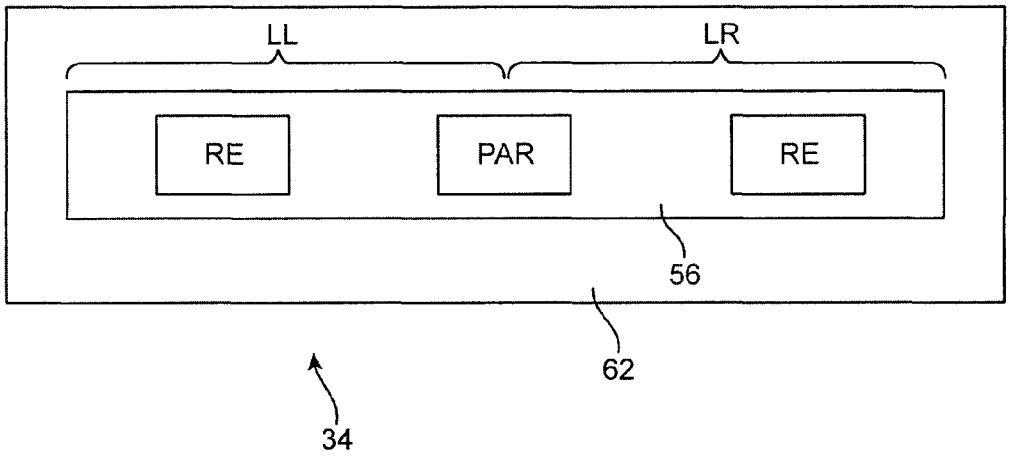
FIG. 26 is a diagram showing how a parasitic antenna element may be introduced into the slot of FIG. 23 between adjacent resonating elements to alter the characteristics of the slot and thereby adjust antenna performance in accordance with an embodiment of the present invention.

FIG. 26 shows how similar results may sometimes be obtained by interposing parasitic element PAR between respective resonating elements RE. In the FIG. 26 example, antenna structures 34 exhibit the undesired resonance peaks of FIG. 24 when parasitic element PAR is not present. When parasitic element PAR is present, however, slot 56 is effectively divided into two sub-slots (i.e., a left-hand slot having length LL and a right-hand slot having length LR). When slot 56 is divided in this way, the modes of each slot are redistributed so that the resonant peaks of the slot no longer interfere with the resonance peaks of the resonating elements. Antenna structures 34 of FIG. 26 may therefore exhibit an antenna response of the type shown in FIG. 22 in which both the low and at 2.4 GHz and the high band at 5 GHz are satisfactorily covered.

Figure 27:
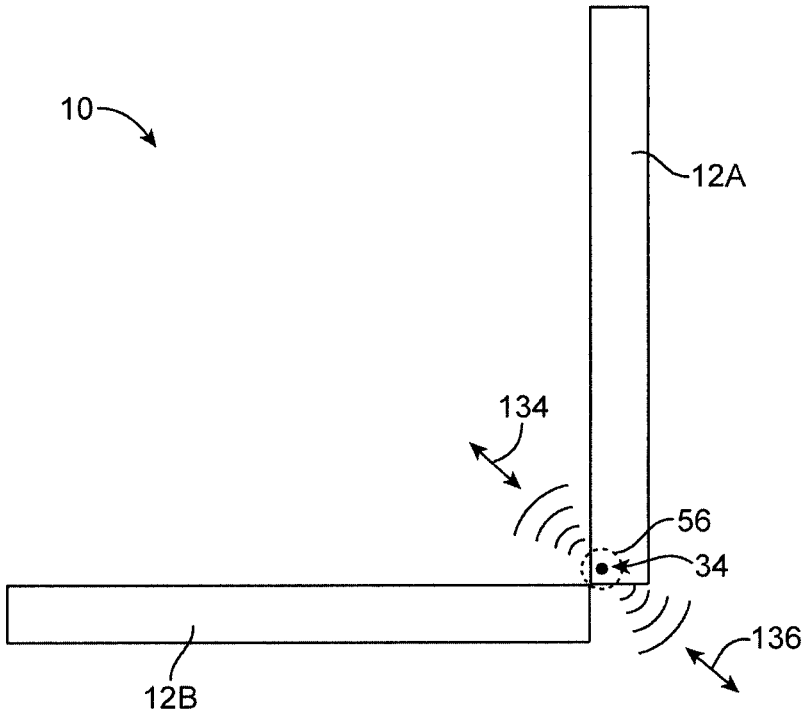
FIG. 27 is a cross-sectional side view of an electronic device such as a portable computer showing how a slot structure may be present when the lid of the device is in an open position in accordance with an embodiment of the present invention.
Figure 28:
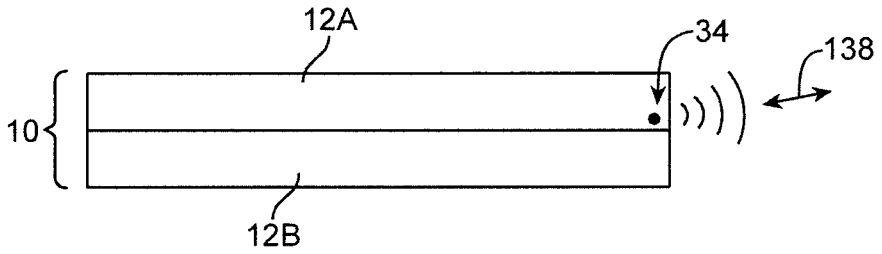
FIG. 28 is a cross-sectional side view of the electronic device of FIG. 27 showing how the slot structure may effectively be absent when the lid of the device is in a closed position in accordance with an embodiment of the present invention.

As shown in FIG. 27, when lid 12A is in an open position, slot 56 may be formed by conductive portions of lid 12A and base housing 12B (e.g., the portions of the housing of device 10 that surround clutch barrel 54 of FIG. 4). In this situation, slot 56 is present and may impact the performance of antenna structures 34. Structures 34 may transmit and receive radio-frequency signals in direction such as directions 134 and directions 136 (as an example). When a user closes lid 12A as shown in FIG. 28, the position of antenna structures 34 and the configuration of housing structures 12A and 12B may shift, so that slot 56 is no longer present (i.e., so that the electromagnetic effects of slot 56 are no longer present or have reduced impact) and so that radio-frequency signals are transmitted and received in directions such as directions 138. Because a user may desire to use the wireless capabilities of device 10 regardless of whether lid 12A is open (as in FIG. 27) or is closed (as in FIG. 28), it may be desirable to desensitize antenna structures 34 to the presence of slot 56, as described in connection with FIGS. 18-26.

Desensitization of antenna structures 34 to the presence of slot 56 and optimization of the location of antenna resonating elements RE and parasitic elements PAR to ensure satisfactory antenna efficiency and isolation between resonating elements may be accomplished by locating components 60 (i.e., antenna resonating elements RE and/or parasitic elements PAR) at appropriate locations within slot 56. Examples of configurations that have been demonstrated to provide satisfactory antenna performance for electronic devices such as portable computers with clutch barrel antenna structures are shown in FIGS. 29-33. In these illustrative configurations, antenna resonating elements RE may be formed using dual band (e.g., 2.4 GHz and 5 GHz) structures of the type shown in FIGS. 8-11. Other types of resonating elements RE (e.g., single band resonating elements, dual band resonating elements of different construction, etc.) may also be used. Antenna configurations in addition to those shown in FIGS. 29-33 (i.e., different antenna structures with one or more antenna resonating elements and one or more optional parasitic elements in slot 56) may be used if desired. The arrangements of FIGS. 29-33 are merely illustrative.

Figure 29:
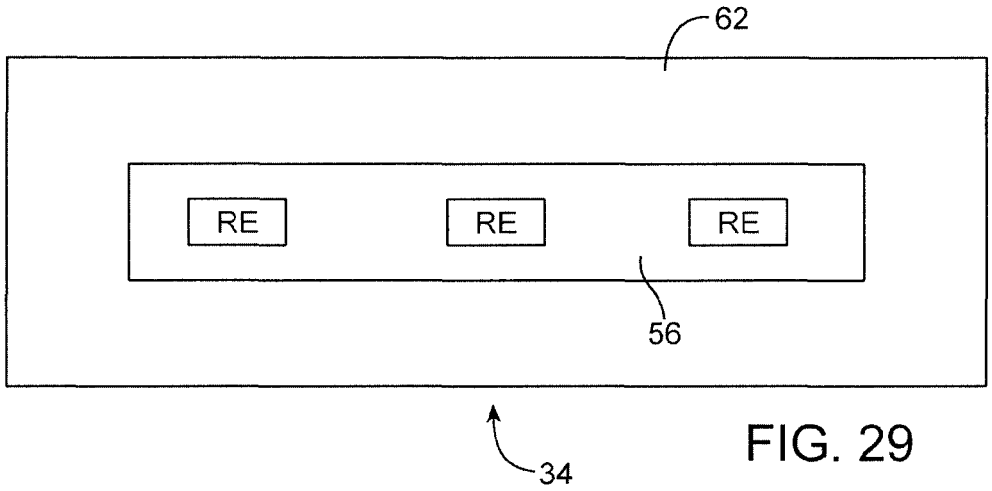
FIG. 29 is a diagram showing how three antenna resonating elements may be mounted within a slot in conductive structures in accordance with an embodiment of the present invention.

FIG. 29 shows an illustrative arrangement that may be used for antenna structures 34 in which three resonating element RE are present in slot 56 and in which no parasitic elements PAR are used.

Figure 30:
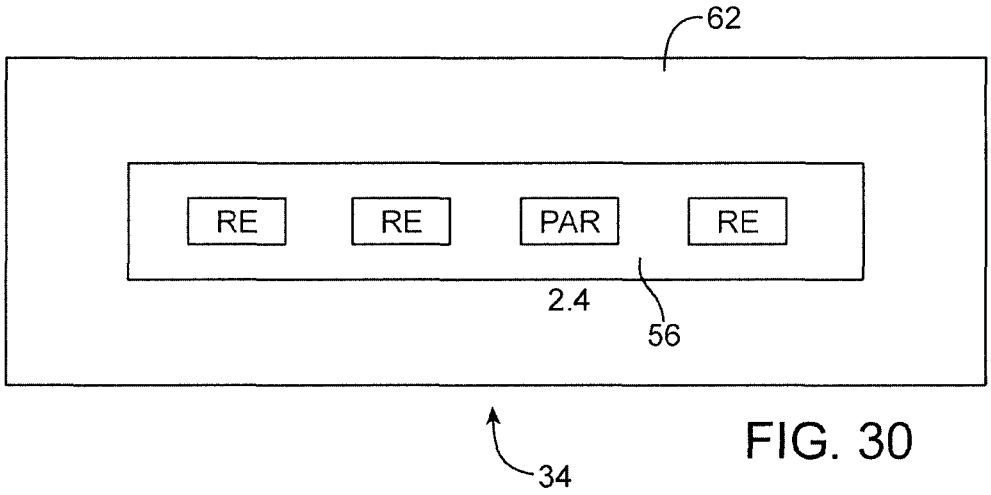
FIG. 30 is a diagram showing how three antenna resonating elements and a parasitic antenna element that is located between adjacent antenna resonating elements may be mounted within a slot in accordance with an embodiment of the present invention.

FIG. 30 shows an illustrative arrangement that may be used for antenna structures 34 in slot 56 that contains three resonating elements RE and in which a parasitic element PAR is interposed between two of the three resonating elements. Parasitic element PAR of FIG. 30 may be configured to operate in a low frequency communications band but not in a high communications band. For example, parasitic element PAR of FIG. 30 may have a configuration of the type shown in FIG. 13 that is effective at 2.4 GHz, but not at 5 GHz (as an example).

Figure 31:
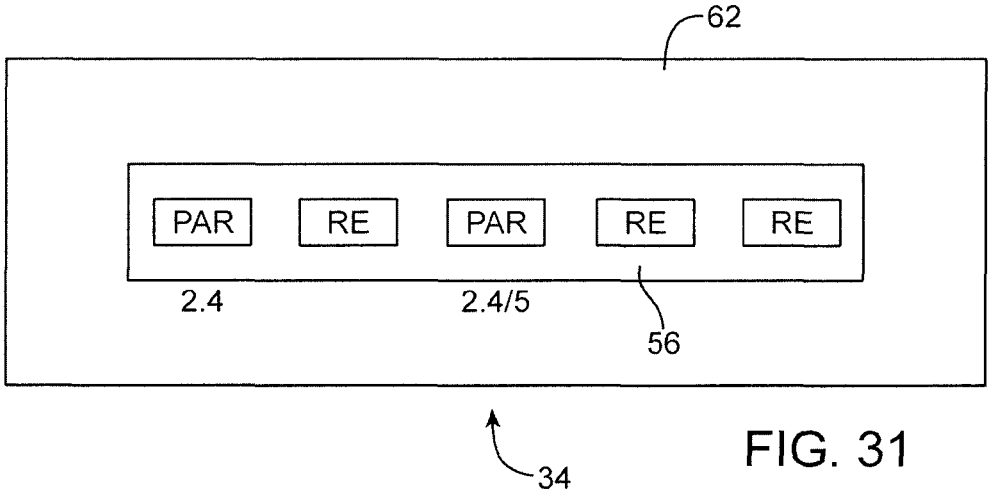
FIG. 31 is a diagram showing how three antenna resonating elements and two parasitic antenna elements may be mounted within a slot in accordance with an embodiment of the present invention.

In the illustrative arrangement shown in FIG. 31, antenna structures 34 have three resonating elements RE and two parasitic elements PAR. The leftmost parasitic element PAR, which is located adjacent to the left end of slot 56, may be configured to operate in the low frequency communications band (e.g., at 2.4 GHz), but not the high frequency band (e.g., at 5 GHz). The leftmost parasitic element may, for example, be implemented using a structure of the types shown in FIG. 13. The rightmost parasitic element PAR, which is located between the leftmost and second-to-leftmost resonating elements RE may be configured to operate in both the low frequency band (e.g., 2.4 GHz) and the high frequency band (e.g., 5 GHz). The rightmost parasitic element may, for example, be implemented using a parasitic element configuration of the type shown in FIG. 14.

Figure 32:
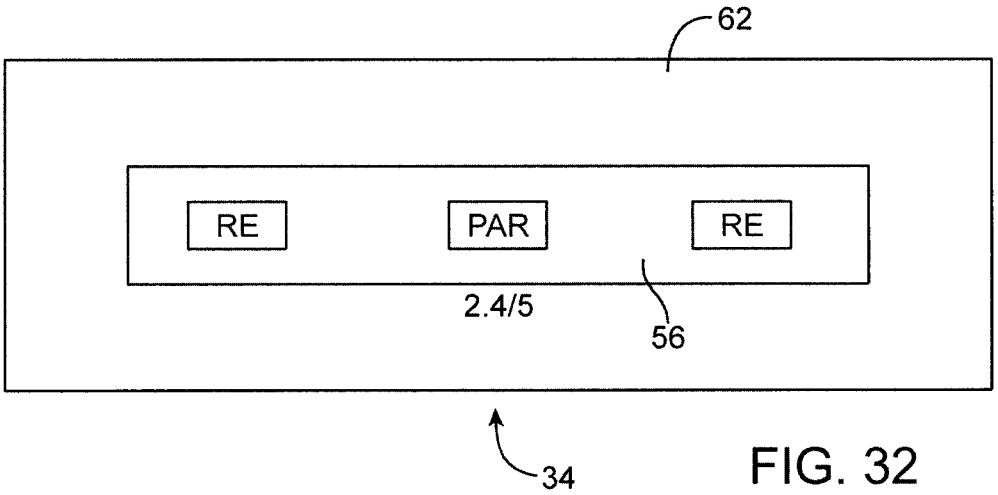
FIG. 32 is a diagram showing how two antenna resonating elements and a dual-band parasitic antenna element that is interposed between the two antenna resonating elements may be mounted within a slot in accordance with an embodiment of the present invention.

FIG. 32 shows an illustrative configuration for antenna structures 34 in which there are resonating elements RE at either end of slot 56. A single parasitic element PAR may be interposed between the respective resonating elements RE. The parasitic element PAR in antenna structures 34 of FIG. 32 may have a configuration of the type shown in FIG. 14 (e.g., the parasitic element may be configured to operate in both a low band such as a 2.4 GHz band and a high band such as a 5 GHz band).

Figure 33:
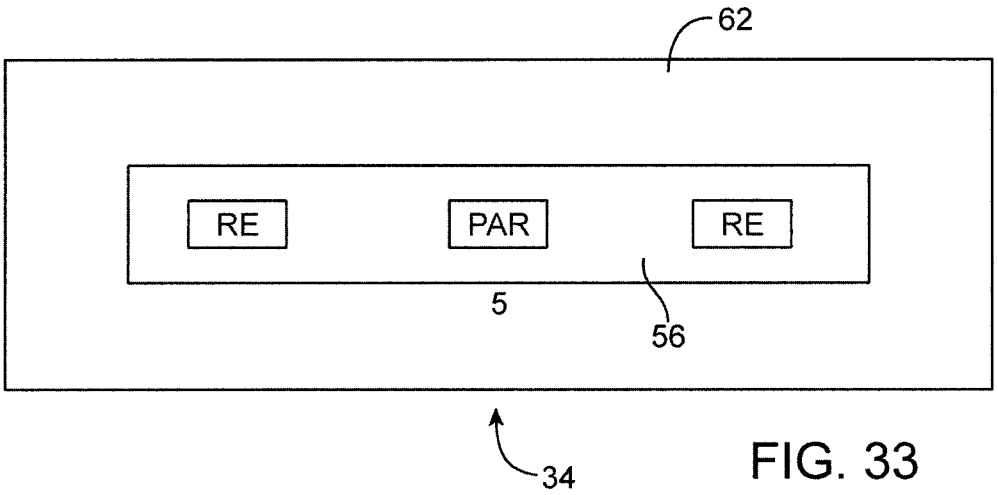
FIG. 33 is a diagram showing how two antenna resonating elements and a single-band parasitic antenna element that is interposed between the two antenna resonating elements may be mounted within a slot in accordance with an embodiment of the present invention.

In configurations of the type shown in FIG. 33, slot 56 contains two resonating elements RE with an interposed parasitic element PAR. Parasitic element PAR of FIG. 33 may, for example, be implemented using a configuration of the type shown in FIG. 12 that is effective in a high frequency communications band (e.g., 5 GHz), but not a low frequency communications band (e.g., 2.4 GHz).

The foregoing is merely illustrative of the principles of this invention and various modifications can be made by those skilled in the art without departing from the scope and spirit of the invention.

What is claimed is:

1. Apparatus, comprising:

a conductive element having an opening, the opening having a first resonant frequency;

an antenna resonating element that is located within the opening and that has a second resonant frequency; and a parasitic antenna element, wherein the parasitic antenna element is formed within the opening at a distance relative to an end of the opening and the parasitic antenna element mitigates interference between the first and second resonant frequencies by shorting the opening at the distance relative to the end of the opening at the second resonant frequency.

2. The apparatus defined in claim 1, wherein the parasitic antenna element adjusts an effective length of the opening to the distance relative to the end of the opening at the second resonant frequency.

3. The apparatus defined in claim 1, further comprising:

an additional antenna resonating element within the opening.

4. The apparatus defined in claim 3, wherein the parasitic antenna element is interposed between the antenna resonating element and the additional antenna resonating element.

5. The apparatus defined in claim 1 wherein the parasitic antenna element and the antenna resonating element comprise conductive traces on a common dielectric substrate.

6. The apparatus defined in claim 1 wherein the second resonant frequency comprises a resonant frequency in a frequency band selected from the group of frequency bands consisting of a 2.4 GHz frequency band and a 5.0 GHz frequency band.

7. The apparatus defined in claim 1 wherein the conductive element comprises metal housing walls for an electronic device.

8. The apparatus defined in claim 1, further comprising:

an additional parasitic antenna element within the opening.

9. The apparatus defined in claim 1, wherein the second resonant frequency comprises a resonant frequency in a corresponding frequency band and the parasitic antenna element mitigates the interference between the first and second resonant frequencies by adjusting the first resonant frequency to a frequency that is outside of the frequency band.

10. The apparatus defined in claim 1, wherein currents that run around a perimeter of the opening define the first resonant frequency.

11. An electronic device, comprising:

conductive structures that define a slot having an effective length;

an antenna resonating element having a resonant frequency; and a parasitic antenna element that is located within the slot at a distance relative to an end of the slot, wherein the parasitic antenna element forms a short circuit at the resonant frequency that shortens the effective length of the slot to the distance relative to the end of the slot.

12. The electronic device defined in claim 11, wherein the resonant frequency lies within a corresponding frequency band, the parasitic antenna element forms an open circuit at frequencies that are outside of the corresponding frequency band, the slot has a first effective length at frequencies that are outside of the frequency band, the slot has a second effective length that is equal to the distance relative to the end at the resonant frequency, and the second effective length is less than the first effective length.

13. The electronic device defined in claim 11, wherein the conductive structures comprise first and second metal electronic device housing walls that surround the slot.

14. The electronic device defined in claim 13, wherein the parasitic antenna element comprises conductive traces on a dielectric substrate within the slot.

15. The electronic device defined in claim 14, wherein at least part of the antenna resonating element is in direct contact with the dielectric substrate.

16. The electronic device defined in claim 15, wherein the antenna resonating element comprises a dual band antenna resonating element that is configured to operate at the resonant frequency and an additional frequency that is different from the resonant frequency.

17. The electronic device defined in claim 16, wherein the parasitic antenna element is configured to form an open circuit across the slot at the additional frequency.

18. An electronic device antenna, comprising:

metal housing structures that run along opposing first and second sides of an elongated opening;

a parasitic element having an elongated segment within the elongated opening that extends along the elongated opening parallel to the opposing first and second sides and having a portion coupled between the elongated segment and the metal housing structures;

an antenna resonating element that operates at a resonant frequency, wherein the parasitic element is active at the resonant frequency; and a dielectric substrate, wherein the parasitic element and at least a portion of the antenna resonating element are in direct contact with a first side of the dielectric substrate.

19. The electronic device antenna defined in claim 18, wherein the metal housing structures comprise a first housing portion and a second housing portion, the first housing portion defines the first side of the elongated opening, the second housing portion defines the second side of the elongated opening, and the first and second housing portions form exterior surfaces for an electronic device.

* * * * *